US011241893B2

(12) United States Patent
Yamamoto

(10) Patent No.: US 11,241,893 B2
(45) Date of Patent: Feb. 8, 2022

(54) HEATING DEVICE, LIQUID APPLYING APPARATUS, IMAGE FORMING APPARATUS, POST-PROCESSING APPARATUS, AND CONVEYING DEVICE

(71) Applicant: Takeshi Yamamoto, Kanagawa (JP)

(72) Inventor: Takeshi Yamamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/195,678

(22) Filed: Mar. 9, 2021

(65) Prior Publication Data

US 2021/0283927 A1 Sep. 16, 2021

(30) Foreign Application Priority Data

Mar. 11, 2020 (JP) ..... JP2020-041912

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/0024
See application file for complete search history.

(56) References Cited

U.S. PATENT DOCUMENTS

2010/0265292 A1* 10/2010 Ohshima ..... B41J 2/1623 347/16
2011/0217091 A1 9/2011 Hirose et al.
2011/0305491 A1 12/2011 Hasegawa et al.
2012/0044516 A1 2/2012 Hirose et al.

FOREIGN PATENT DOCUMENTS

JP 2003-054116 2/2003

* cited by examiner

*Primary Examiner* — Bradley W Thies
(74) *Attorney, Agent, or Firm* — Xsensus LLP

(57) ABSTRACT

A heating device includes a first member having a first sheet holding face, and a second member having a second sheet holding face and disposed facing the first sheet holding face of the first member. The first and second sheet holding faces are configured to hold a sheet between the first and second sheet holding faces. The sheet has a resin surface on at least one face of the sheet. The heating device is configured to heat the sheet while the first and second sheet holding faces hold the sheet on which liquid is applied. At least one of the first and second sheet holding faces is configured to contact the resin surface of the sheet. The at least one of the first and second sheet holding faces has an uneven surface with a plurality of convex or concave portions.

24 Claims, 25 Drawing Sheets

HEATING DEVICE, LIQUID APPLYING APPARATUS, IMAGE FORMING APPARATUS, POST-PROCESSING APPARATUS, AND CONVEYING DEVICE

CROSS-REFERENCE TO RELATED APPLICATION

This patent application is based on and claims priority pursuant to 35 U.S.C. § 119(a) to Japanese Patent Application No. 2020-041912, filed on Mar. 11, 2020, in the Japan Patent Office, the entire disclosure of which is hereby incorporated by reference herein.

BACKGROUND

Technical Field

Embodiments of the present disclosure relate to a heating device, a liquid applying apparatus, an image forming apparatus, a post-processing apparatus, and a conveying device.

Background Art

For example, various types of inkjet image forming apparatuses are known to include a heating device to heat a sheet on which liquid such as ink is applied.

A known inkjet image forming apparatus heats a sheet on which an image is formed by applying ink, while holding the sheet by a heat belt and a pressure belt.

SUMMARY

At least one aspect of this disclosure, a novel heating device includes a first member having a first sheet holding face, and a second member having a second sheet holding face and disposed facing the first sheet holding face of the first member. The first sheet holding face and the second sheet holding face are configured to hold a sheet between the first sheet holding face and the second sheet holding face. The sheet has a resin surface on at least one of a first face and a second face of the sheet. The heating device is configured to heat the sheet while the first sheet holding face and the second sheet holding face hold the sheet on which liquid is applied. At least one of the first sheet holding face and the second sheet holding face is configured to contact the resin surface of the sheet. The at least one of the first sheet holding face and the second sheet holding face has an uneven surface with a plurality of convex or concave portions.

Further, at least one aspect of this disclosure, a liquid applying apparatus includes a liquid applier configured to apply liquid to a sheet, and the above-described heating device.

Further, at least one aspect of this disclosure, an image forming apparatus includes an image forming device configured to form an image on a sheet with liquid, and the above-described heating device.

Further, at least one aspect of this disclosure, a post-processing apparatus includes the above-described heating device, and a post-processing device configured to perform a post-processing operation to a sheet that has passed the heating device.

Further, at least one aspect of this disclosure, a conveying device includes the above-described heating device, and a conveyance passage configured to convey a sheet that has passed the heating device, to a post-processing device to perform a post-processing operation to the sheet.

Further, at least one aspect of this disclosure, another novel heating device includes a first member having a first sheet holding face, and a second member having a second sheet holding face and disposed facing the first sheet holding face of the first member. The first sheet holding face and the second sheet holding face are configured to hold a sheet between the first sheet holding face and the second sheet holding face. The sheet has a resin surface on at least one of a first face and a second face of the sheet. The heating device is configured to heat the sheet while the first sheet holding face and the second sheet holding face hold the sheet on which liquid is applied. A temperature of the first sheet holding face and a temperature of the second sheet holding face are equal to or lower than a softening point of the resin surface of the sheet.

Further, at least one aspect of this disclosure, a liquid applying apparatus includes a liquid applier configured to apply liquid to a sheet, and the above-described heating device.

Further, at least one aspect of this disclosure, an image forming apparatus includes an image forming device configured to form an image on a sheet with liquid, and the above-described heating device.

Further, at least one aspect of this disclosure, a post-processing apparatus includes the above-described heating device, and a post-processing device configured to perform a post-processing operation to a sheet that has passed the heating device.

Further, at least one aspect of this disclosure, a conveying device includes the above-described heating device, and a conveyance passage configured to convey a sheet that has passed the heating device, to a post-processing device to perform a post-processing operation to the sheet.

BRIEF DESCRIPTION OF THE SEVERAL VIEWS OF THE DRAWINGS

Exemplary embodiments of this disclosure will be described in detail based on the following figures, wherein.

Figure 1:
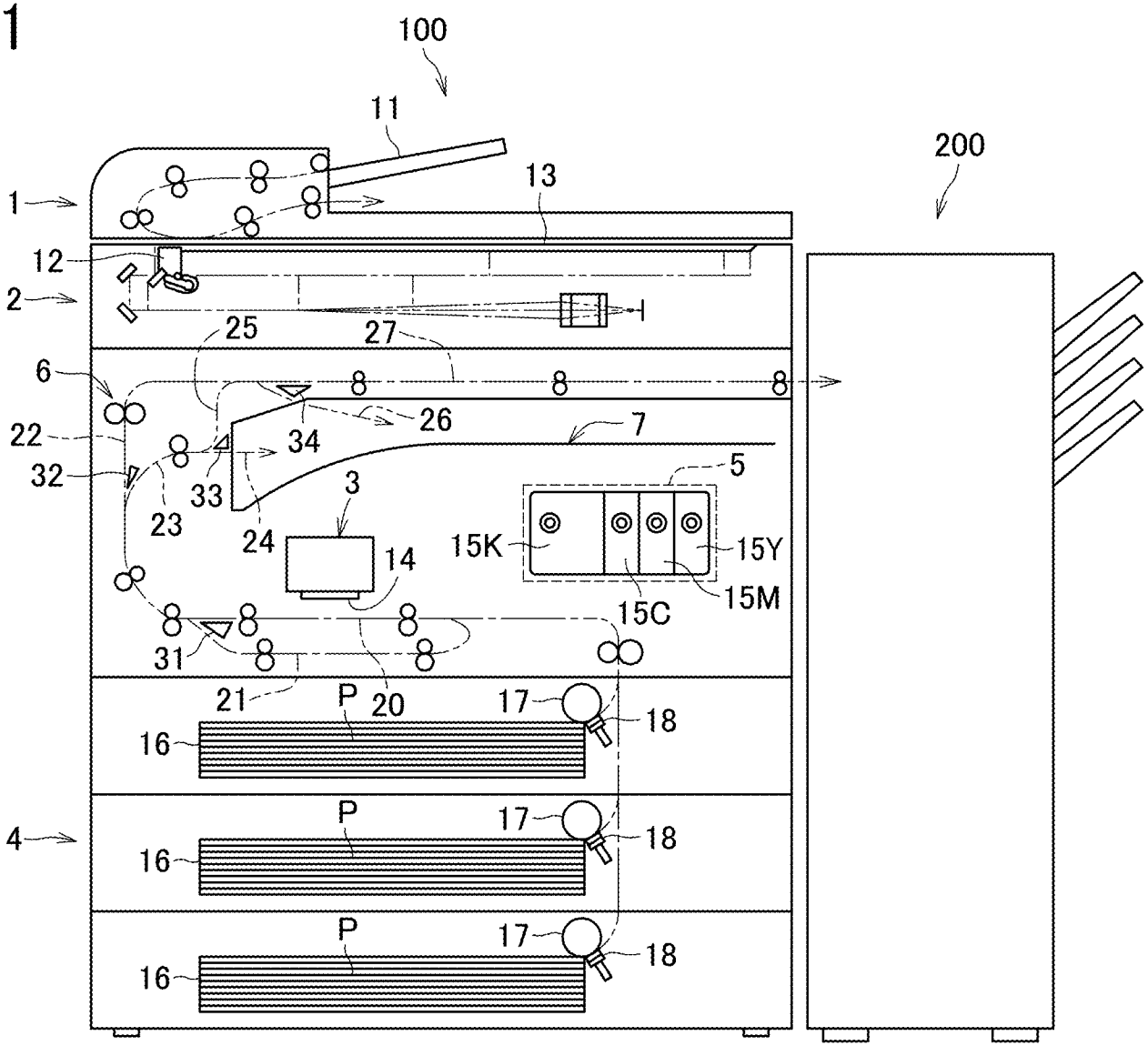
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components)

having the same function or shape and redundant descriptions thereof are omitted below.

Descriptions are given of an example applicable to a heating device, a liquid applying apparatus, an image forming apparatus, a post-processing apparatus, and a conveying device. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device (heating device) 6, and a sheet ejection portion 7. Further, a sheet alignment apparatus 200 is disposed adjacent to the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid applier to apply liquid to a sheet. The liquid discharge head 14 discharges ink that is liquid used for image formation and applies the ink to the sheet. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The sheet alignment apparatus 200 functions as a post-processing apparatus to align and register the sheets P conveyed from the image forming apparatus 100. Further, in addition to the sheet alignment apparatus 200, another post-processing apparatus such as a stapling device that staples (binds) the sheets and a punching device that punches holes in the sheet may be installed.

To provide a fuller understanding of the embodiments of the present disclosure, a description is now given of the image forming operation of the image forming apparatus 100 according to the present embodiment of this disclosure, with continued reference to FIG. 1.

As an instruction is given to start the printing operation, the sheet P is fed from one sheet feed tray 16 of the plurality of sheet feed trays 16. To be more specific, as the sheet feed roller 17 rotates, the uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 20 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image. Note that the image to be formed on the sheet P may be a meaningful image such as text or a figure, or a pattern having no meaning per se.

When a duplex printing is performed, the sheet P is conveyed in the opposite direction opposite the sheet conveyance direction at a position downstream from the image forming device 3 in the sheet conveyance direction, so that the sheet P is guided to a sheet reverse passage 21. To be more specific, after the trailing end of the sheet P has passed a first passage changer 31 that is disposed downstream from the image forming device 3 in the sheet conveyance direction, the first passage changer 31 changes the sheet conveyance passage to the sheet reverse passage 21, and therefore the sheet P is conveyed in the opposite direction. Accordingly, the sheet P is guided to the sheet reverse passage 21. Then, as the sheet P passes through the sheet reverse passage 21, the sheet P is reversed upside down and conveyed to the image forming device 3 again. Then, the image forming device 3 repeats the same operation performed to the front face of the sheet P, so as to form an image on the back face of the sheet P.

A second passage changer 32 is disposed downstream from the first passage changer 31 in the sheet conveyance direction. The second passage changer 32 guides the sheet P with the image selectively to a sheet conveyance passage 22 that runs through the drying device 6 or to a sheet conveyance passage 23 that does not run through the drying device 6. When the sheet P is guided to the sheet conveyance passage 22 through which the sheet P passes the drying device 6, the drying device 6 dries the ink on the sheet P. On the other hand, when the sheet P is guided to the sheet conveyance passage 23 through which the sheet P does not pass the drying device 6, a third passage changer 33 guides the sheet P selectively to a sheet conveyance passage 24 toward the sheet ejection portion 7 or to a sheet conveyance passage 25 toward the sheet alignment apparatus 200. Further, after the sheet P has passed the drying device 6, a fourth passage changer 34 guides the sheet P selectively to a sheet conveyance passage 26 toward the sheet ejection portion 7 or to a sheet conveyance passage 27 toward the sheet alignment apparatus 200.

In a case in which the sheet P is guided to the sheet conveyance passage 24 or the sheet conveyance passage 26 toward the sheet ejection portion 7, the sheet P is ejected to the sheet ejection portion 7 with an image forming surface down. Here, the image forming surface indicates a liquid applied face of the sheet P on which ink is applied. On the other hand, in a case in which the sheet P is guided to the sheet conveyance passage 25 or the sheet conveyance passage 27 toward the sheet alignment apparatus 200, the sheet P is conveyed to the sheet alignment apparatus 200, so that the bundle of sheets P is aligned and stacked. Accordingly, a series of printing operations of the print job is completed.

Next, a description is given of the configuration of the drying device 6 according to the present embodiment.

Figure 2:
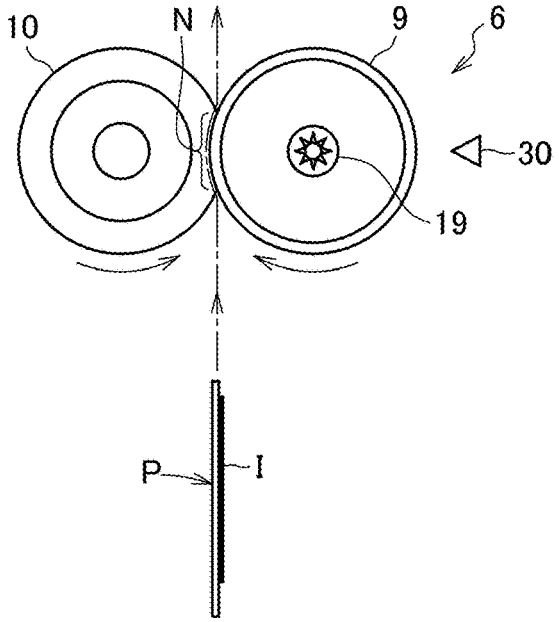
FIG. 2 is a diagram illustrating a schematic configuration of a drying device provided in the image forming apparatus of FIG. 1, according to an embodiment of the present disclosure.

FIG. 2 is a diagram illustrating a schematic configuration of the drying device 6 included in the image forming apparatus 100 of FIG. 1, according to an embodiment of the present disclosure.

As illustrated in FIG. 2, the drying device 6 includes a heat roller 9, a pressure roller 10, a heater 19, and a temperature sensor 30.

The heat roller 9 is a heating member that heats the sheet P and is a heat rotator that rotates. In the present embodiment, the heat roller 9 is a hollow roller having the outer diameter of, e.g., 30 mm and has a cylindrical iron core metal and a release layer formed on the outer circumferential surface of the iron core metal. The iron core metal has a thickness of, e.g., 0.5 mm and is made of iron alloy or aluminum alloy. Further, the release layer is made of a fluororesin.

The pressure roller 10 is a pressing member that is pressed by the heat roller 9 and is a pressure rotator that is a pressure body that rotates. In the present embodiment, the pressure roller 10 is a hollow roller having the outer diameter of, e.g., 30 mm and has a cylindrical iron core metal, an elastic layer formed on the outer circumferential surface of the cylindrical iron core metal, and a release layer formed on the outside of the elastic layer. The iron core metal is made of iron alloy, for example. The elastic layer is made of silicone rubber and has a thickness of, e.g., 3.5 mm. Further, the release layer is made of a fluororesin. In the drying device 6 according to the present embodiment, since the pressure roller 10 is biased toward the heat roller 9 by a pressing member such as a spring and a cam, the pressure roller 10 is pressed in contact with the outer circumferential surface of the heat roller 9. Thus, the nip region N is formed between the heat roller 9 and the pressure roller 10.

The heater 19 is a heat source to heat the heat roller 9. In the present embodiment, the heater 19 is disposed inside the heat roller 9, so that the heat roller 9 is heated from inside by the heater 19. Further, the heater 19 may be disposed outside the heat roller 9. As a heat source, a radiation-type heater, e.g., a halogen heater and a carbon heater, to emit infrared ray, and an electromagnetic induction-type heat source may be employed. Further, the heater may be a contact-type heater or a non-contact type heater. In the present embodiment, a halogen heater is used as a heater 19.

Further, the temperature sensor 30 functions as a temperature detector to detect the surface temperature of the heat roller 9, in other words, the temperature of the outer circumferential surface of the heat roller 9. By controlling the output of the heater 19 based on the surface temperature of the heat roller 9 detected by the temperature sensor 30, the surface temperature of the heat roller 9 is controlled to be a desired temperature (fixing temperature). To be more specific, the heater 19 is controlled to maintain the surface temperature of the heat roller 9 within the range of, e.g., from 100 degrees Celsius to 180 degrees Celsius. The temperature sensor 30 may be any of a contact-type sensor and a non-contact sensor. As the temperature sensor 30, a known temperature sensor such as a thermopile, a thermostat, a thermistor, or an NC (normally closed) sensor may be applied.

Next, a description is given of the operation and functions of the drying device 6.

As the instruction for image formation is issued to the image forming apparatus 100, as illustrated in FIG. 2, the pressure roller 10 rotated in a direction indicated by arrow in FIG. 2 (that is, a counterclockwise direction). By so doing, the heat roller 9 is rotated together with the rotation of the pressure roller 10. On the other hand, the heat roller 9 may rotate and the pressure roller 10 may be rotated together with the rotation of the heat roller 9. Further, the heater 19 starts to generate heat, so that the heat roller 9 is heated by the heater 19. Further, the pressure roller 10 in contact with the heat roller 9 is also indirectly heated.

In a case in which the surface temperature of the heat roller 9 has reached the target temperature (for example, 100 to 180 degrees Celsius) and the sheet P on which liquid ink I is applied is conveyed to the drying device 6, as illustrated in FIG. 2, as the sheet P enters (the nip region N) between the heat roller 9 and the pressure roller 10, the sheet P is conveyed by a pair of rotating rollers, which are the heat roller 9 and the pressure roller 10, while being held by the pair of rollers. At this time, the sheet P is continuously heated by the heat roller 9, which further accelerates the drying of the ink I on the sheet P. Note that the pressure roller is also heated for some extent, the sheet P is also heated by the pressure roller 10. Then, the sheet P is ejected from (the nip region N) between the heat roller 9 and the pressure roller and is conveyed to the sheet ejection portion 7 or the sheet alignment apparatus 200 as described above.

Alternatively, when performing duplex printing, after images have been formed on both the front and back faces of the sheet P, the sheet P may be conveyed to the drying device 6 to dry the ink on the front and back faces of the sheet P simultaneously or the image on the front face of the sheet P and the image on the back face of the sheet P may be dried separately. In particular, in a case in which the image on the front face of the sheet P and the image on the back face of the sheet P are dried separately, it is preferable that, after the image on the front face of the sheet P has been dried, the sheet P is conveyed to the image forming device 3 again without passing through the drying device 6. For example, after the sheet P has passed through the drying device 6 to dry the image on the front face of the sheet P, the sheet P is switched back and conveyed in the sheet conveyance passage 25 and the sheet conveyance passage 23 illustrated in FIG. 1. Then, the sheet P is guided to the image forming device 3 via the sheet reverse passage 21 illustrated in FIG. 1. Further, the sheet P may not be conveyed in the sheet conveyance passage 25 and the sheet conveyance passage 23, but may be conveyed toward upstream from the sheet conveyance passage 22 (upstream from the drying device 6) in the sheet conveyance direction via a different sheet conveyance passage that detours the drying device 6 and may be guided to the image forming device 3 via the sheet reverse passage 21. Then, after the image forming device 3 has formed an image on the back face of the sheet P, the sheet P is conveyed to the drying device 6 again to cause the drying device 6 to perform the drying process on the image on the back face of the sheet P.

In an inkjet type image forming apparatus, a sheet having an ink absorbing layer on the surface, which easily absorbs ink, may be used for the purpose of enhancing the image quality. Examples of the ink absorbing layer include one or a plurality of fine particles made of porous silica, alumina, and the like, and further containing a binder and a cross-linking agent for the binder. Further, as the binder, for example, polyvinyl alcohol (PVC) or polymethylmethacrylate (PMMA) is used.

However, some resins composing the ink receiving layer have a softening point equal to or lower than the heating temperature of the drying device. Therefore, when a sheet on which an ink receiving layer having such a low softening point is used, the heat of the drying device may soften the resin in the ink absorbing layer. In that case, it is likely that the sheet sticks to one of the heat roller and the pressure roller that hold the sheet together.

Note that the "softening" here represents a phenomenon of glass transition in the thermoplastic resin, and the "softening point" here represents a glass transition temperature (Tg) of the thermoplastic resin. For example, in the case of an ink absorbing layer containing PVC as a binder, the softening point (Tg) is 60 to 90° C., and in the case of an ink absorbing layer containing PMMA, the softening point (Tg) is 80 to 100° C. As a method of measuring the softening point (Tg) of the ink absorbing layer, JIS-7121-1987 "Plastic-thermoplastic-Vicat softening temperature (VST) test method" may be used, and the softening point measured by this measuring method (glass transition temperature) is the softening point of the ink absorbing layer.

As a solution to sheet sticking, a known electrophotographic image forming apparatus that forms an image using toner includes a claw-shaped sheet separation member that is disposed near the exit of the nip region between a pair of rollers so as to separate the sheet. In this case, the leading end the sheet that has passed through the nip region comes into contact with the sheet separation member, so that the sheet is mechanically separated from the roller. However, in a case in which such a sheet separating member is applied to a drying device provided in an inkjet image forming apparatus, the sheet slips through a small gap between the tip end of the sheet separation member and the surface of the roller, and the sheet may not be separated from the roller. That is, when the sheet is plain paper, even if there is such a small gap, at least the leading end of the sheet is often separated from the roller, so that the sheet is separated as the tip end of the sheet separation member slips between the leading end of the sheet and the surface of the roller. On the other hand, when the sheet includes the ink absorbing layer, the ink absorbing layer is generally formed over the surface from the leading end of the sheet. Therefore, if the resin of the ink absorbing layer softens, the sheet sticks to the roller from the leading end of the sheet. Therefore, the tip end of the sheet separation member cannot slip between the sheet and the roller, so that the sheet is likely to pass through the small gap of the sheet separation member. Therefore, simply providing the sheet separation member is not sufficient to restrain the sticking of the sheet having the ink absorbing layer. In order to address this inconvenience, the drying device according to the present embodiment provides the following measurement to effectively restrain the above-described sheet sticking problem.

Next, a description is given of the configuration to restrain the sticking of a sheet.

Figure 3:
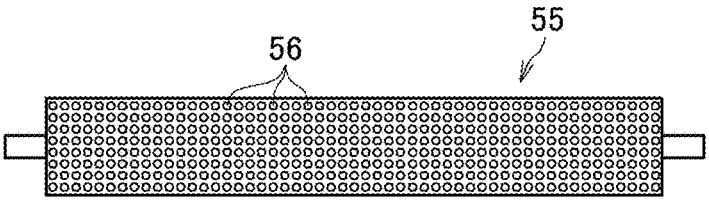
FIG. 3 is an external view illustrating a knurled roller.

FIG. 3 is an external view illustrating a knurled roller.

Figure 4:
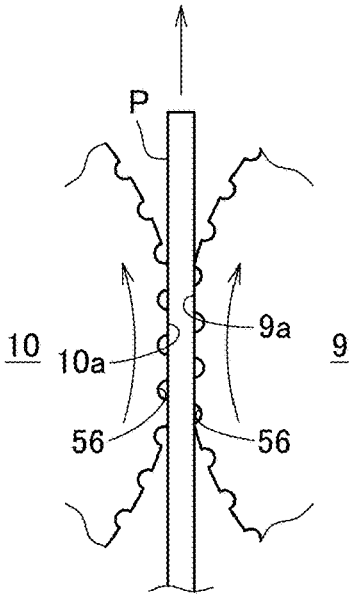
FIG. 4 is an enlarged view illustrating the nip region between a heat roller and a pressure roller.

FIG. 4 is an enlarged view illustrating the nip region between a heat roller and a pressure roller.

In the drying device according to the present embodiment, in order to restrain the sticking of the sheet P to the heat roller 9 and the pressure roller 10 illustrated in FIG. 2, each of the heat roller 9 and the pressure roller 10 employs a knurled roller 55 having the outer circumferential surface with a plurality of concave portions 56 as illustrated in FIG. 3. Instead of the plurality of concave portions 56, the roller may have the outer circumferential surface with a plurality of convex portions.

By employing the knurled roller 55 having the outer circumferential surface with asperities as the heat roller 9 and the pressure roller 10, when the heat roller 9 and the pressure roller 10 convey the sheet P on which the ink is applied while holding the sheet as illustrated in FIG. 4, the contact area of the sheet P with each of a pair of sheet holding faces 9*a* and 10*a* (that is, the outer circumferential surfaces of the heat roller 9 and the pressure roller 10) is decreased when compared with a roller having no asperities (convex and concave portions). Therefore, it becomes difficult for the sheet P to closely sticks the heat roller 9 and the pressure roller 10, the separation performance of the sheet P from the heat roller 9 and the pressure roller 10 enhances. Accordingly, the sticking of the sheet P to the heat roller 9 and the pressure roller 10 is restrained.

Accordingly, by employing the drying device according to the present embodiment, even in the image forming apparatus using the sheet having the ink absorbing layer with the softening point of the surface temperature (temperature on the outer circumferential surface) of each of the heat roller 9 and the pressure roller 10, the sheet sticking to the heat roller 9 and the pressure roller 10 is restrained, and therefore the sheet is ejected from the drying device 6 reliably. Further, by employing the knurled roller 55 as the heat roller 9 and the pressure roller 10 as illustrated in FIG. 3, the application of ink to the heat roller 9 and the pressure roller 10. Therefore, image distortion (ink smudging) on the sheet or ink adhesion (stains) on the heat roller 9 and the pressure roller 10 are less likely to occur. Further, as in the drying device according to the present embodiment, the outermost layer (outer circumferential surface) of each of the heat roller 9 and the pressure roller 10 is a release layer including fluororesin. This structure of each of the heat roller 9 and the pressure roller 10 further enhances the separation performance of the sheet from each of the heat roller 9 and the pressure roller 10 and restrains the sheet sticking and ink adhesion (stains) onto the heat roller 9 and the pressure roller 10 more effectively.

As described above, according to the present disclosure, the sheet sticking to the sheet holding body that holds the sheet is restrained, thereby employing a drying device that heats the sheet while holding the sheet. Accordingly, since a large-size warm air generator may not be used as a drying device, a reduction in size and cost of the apparatus is achieved. In addition, by employing a drying device that heats the sheet while holding the sheet, even when the sheet has deformation such as cockling (waving), the distortion of the sheet is reduced or corrected by holding the sheet, and therefore the conveyance performance and loading performance of the sheet are increased.

Figure 5:
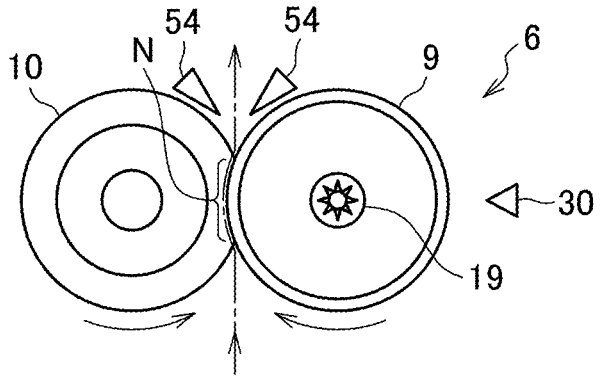
FIG. 5 is a diagram illustrating an example of sheet separation members disposed at the exit of the nip region.

Further, FIG. 5 is a diagram illustrating an example of sheet separation members disposed at the exit of the nip region.

As in the example illustrated in FIG. 5, claw-shaped separators 54 may be disposed on the exit side of the nip region N (downstream from the nip region N in the sheet conveyance direction). The separators 54 contact the sheet P to separate the sheet P from the heat roller 9 and the pressure roller 10. In this case, even if the separators 54 are disposed facing the heat roller 9 and the pressure roller 10 and the tip ends of the separators 54 are disposed not in contact with the heat roller 9 and the pressure roller 10 with respective small gaps, the separators 54 are capable of separating the sheet form the heat roller 9 and the pressure roller 10. That is, as described above, by employing the knurled roller 55 as each of the heat roller 9 and the pressure roller 10, the separation performance of the sheet with respect to the heat roller 9 and the pressure roller 10 is enhanced, so that at least the leading end of the sheet separates from each of the heat roller 9 and the pressure roller 10. Therefore, it becomes less likely that the leading end of the sheet slips the small gap between each separator 54 and each of the heat roller 9 and the pressure roller 10. Therefore, by further providing the separators 54 in the drying device 6 according to the present embodiment, the separation performance of the sheet with respect to the heat roller 9 and the pressure roller 10 is enhanced. Note that the separator 54 is not limited to be disposed facing each of the heat roller 9 and the pressure roller 10 but may be disposed facing one of the heat roller 9 and the pressure roller 10.

Figure 6:
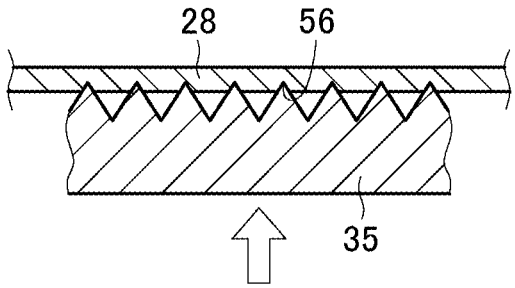
FIG. 6 is a diagram illustrating an example of a method to form the uneven surface on a roller.

FIG. 6 is a diagram illustrating an example of a method to form the uneven surface on a roller.

As a method of forming asperities on the outer circumferential surface of a roller, for example, as illustrated in FIG. 6, an embossed mold 35 having a plurality of protrusions is pressed against a sheet-like member 28 constructing the elastic layer of the roller to form a plurality of concave portions 56. Further, when forming asperities (convex and concave portions) on a flexible cylindrical member, it is difficult to use the above-described method using the embossed mold 35 (embossing). Alternatively, for forming the uneven surface, it is preferable to use the blasting in which a stream of material, e.g., sand or beads, is forcibly propelled against the outer circumferential surface of a cylindrical member or the sanding in which the outer circumferential surface of a member is partly removed by rubbing a sandpaper. In that case, the asperities (convex and concave portions) are formed to a desired size by adjusting the particle size of the sand or beads to be sprayed or by adjusting the roughness of the sandpaper.

The height of the convex portions of the asperities is preferably 10 μm or more, more preferably from 50 μm to 500 μm, and more preferably from 100 μm to 300 μm. By setting the height of the convex portions to 10 μm or more, the sheet has the good separation performance with respect to the rollers reliably.

Figure 7:
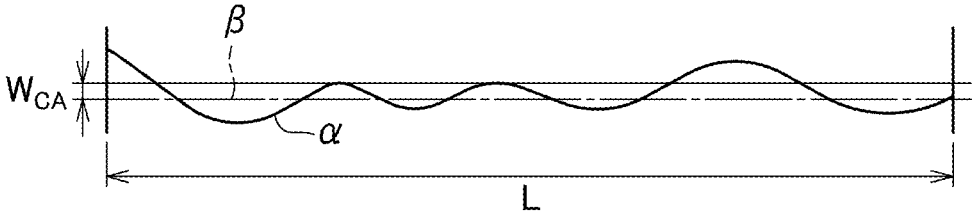
FIG. 7 is a diagram illustrating a filtered center line waviness profile.

Further, FIG. 7 is a diagram illustrating a filtered center line waviness profile.

The height of the asperities may be evaluated by, for example, a $W_{CA}$ value representing a characteristic value of a waviness profile associated with the surface roughness. The $W_{CA}$ value is represented as the value of the filtered center line waviness and is obtained by extracting a portion having the measured length L from the filtered center line waviness profile a in the direction of the centerline β illustrated in FIG. 7 and then calculating and averaging the absolute value of the deviation of the centerline β of the extracted portion and the filtered center line waviness profile a. To be more specific, the $W_{CA}$ value is obtained by using the following equation, Equation 1. It is preferable that the $W_{CA}$ value of the asperities (convex and concave portions) thus calculated is 0.8 μm or more in order to provide the separation performance of the sheet.

$$W_{CA} = \frac{1}{L}\int_0^L |f(x)|dx. \quad \text{Equation 1}$$

As described above, with the drying device according to the present embodiment, even if the sheet is heated at a temperature higher than the softening point of the ink absorbing layer, the sticking of the sheet to the roller is restrained, thereby heating the sheet effectively and accelerating the drying of the ink. On the other hand, in a case in which restraining the sticking of the sheet to the heat roller 9 and the pressure roller 10 is prior to acceleration of the drying of the ink, the surface temperature of each of the heat roller 9 and the surface temperature of the pressure roller 10 (i.e., the temperature of each of the sheet holding faces 9*a* and 10*a*) may be equal to or lower than the softening point of the ink absorbing layer. As a result, the ink absorbing layer is less likely to soften, so that the sheet is less likely to be stuck to the roller in the configuration using the above-described knurled roller 55.

Further, since the amount and time of heat for drying the ink depend on the amount of ink applied to the sheet, the temperature for heating the sheet may be controlled based on the amount of ink applied to the sheet.

Figure 8:
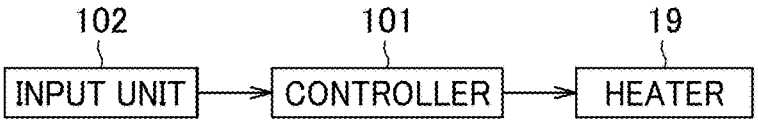
FIG. 8 is a block diagram illustrating a control system that controls the temperature of the drying device based on the amount of ink applied to a sheet.

FIG. 8 is a block diagram illustrating a control system that controls the temperature of the drying device based on the amount of ink applied to a sheet.

As illustrated in FIG. 8, the image forming apparatus 100 includes a controller 101 that controls the temperature of the heater 19. The controller 101 controls the temperature of the heater 19 based on the image information input via the input unit 102 of a terminal other than the image reading device 2 or the image forming apparatus 100. The information input via the input unit 102 is not limited to image information but may include mode information selected from image forming modes having different resolutions. To be more specific, the controller 101 acquires the image resolution or the image area rate of the image from the image information input from the input unit 102, and controls the temperature of the heater 19 based on the acquired image resolution or the acquired image area rate of the image. That is, since the amount of ink applied to the sheet changes according to the image resolution and the image area rate of the image, the amount of ink applied to the sheet here is substituted by the image resolution and the image area rate. Further, the amount of ink applied to the sheet is not limited to the image information input via the input unit 102 and may be specified based on the total amount of ink discharged from the liquid discharge head 14 of the image forming device 3.

Figure 9:
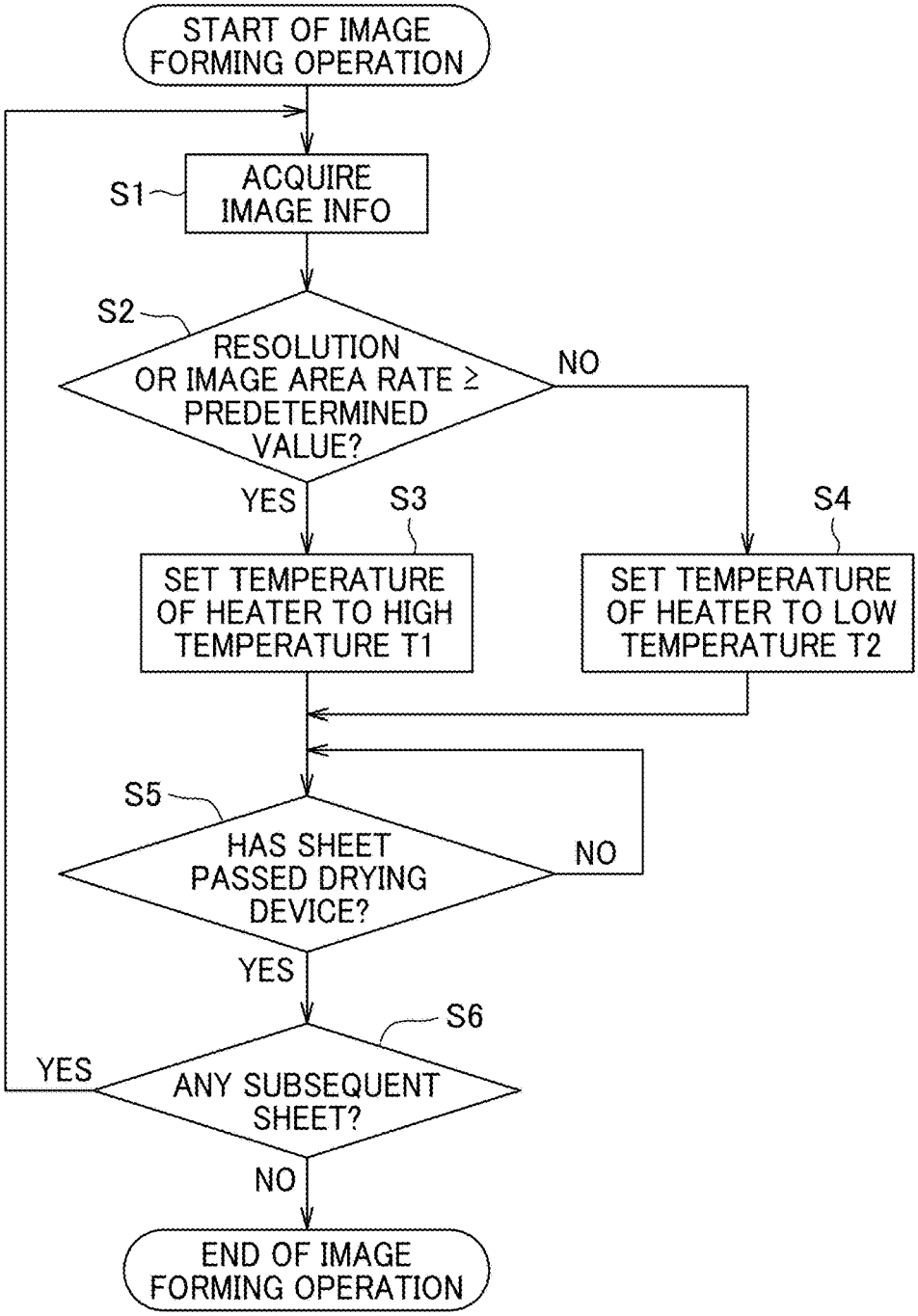
FIG. 9 is a flowchart of the temperature control flow of a heater.

Next, a description is given of the control flow of the temperature of the heater, with reference to FIG. 9.

FIG. 9 is a flowchart of the control flow of the temperature of a heater.

As an image formation command is issued to start the image forming operation, the controller 101 first acquires image formation from the input unit 102 (step S1 in the flowchart of FIG. 9), and determines whether the image resolution or the image area rate of the image acquired from the image formation is equal to or greater than the predetermined value (step S2 in the flowchart of FIG. 9).

As a result, when the image resolution or the image area rate is equal to or higher than the predetermined value (YES in step S2 in the flowchart of FIG. 9), it is determined that the amount of ink applied to the sheet is relatively large (in other words, greater than the predetermined amount), and the temperature of the heater 19 is set to a high temperature T1 (step S3 in the flowchart of FIG. 9). Consequently, the surface temperature of the heat roller 9 and the surface temperature of the pressure roller 10 (that is, the temperatures of the respective sheet holding faces that hold the sheet) are controlled to be higher than the softening point of the ink absorbing layer (resin surface).

As described above, when it is determined that the amount of ink applied to the sheet is relatively large, the controller 101 causes the surface temperature of the heat roller 9 and the surface temperature of the pressure roller 10 to be a relatively high temperature. Accordingly, even if the sheet has a large amount of ink, the sheet is heated effectively, thereby accelerating the drying of the ink on the sheet. Note that, also in this case, as in the above-described embodiments, each of the heat roller 9 and the pressure roller 10 employs the knurled roller 55. Therefore, even if the sheet is heated at the temperature higher than the softening point of the ink absorbing layer, the sticking of the sheet to the heat roller 9 and the pressure roller 10 is restrained.

On the other hand, when the controller 101 has determined that the image resolution or the image area rate is less (lower) than the predetermined value (NO in step S2 in the flowchart of FIG. 9), it is determined that the amount of ink applied to the sheet is relatively small (in other words, equal to or smaller than the predetermined amount), the temperature of the heater 19 is set to a low temperature T2 that is lower than the temperature T1 (step S4 in the flowchart of FIG. 9). Consequently, the surface temperature of the heat roller 9 and the surface temperature of the pressure roller 10 (that is, the temperatures of the respective sheet holding faces that hold the sheet) are controlled to be equal to or lower than the softening point of the ink absorbing layer (resin surface).

As described above, when it is determined that the amount of ink applied to the sheet is relatively small, the ink is dried without heating the sheet at a relatively high temperature. Further, since the surface temperature of the heat roller 9 and the surface temperature of the pressure roller 10 are controlled to be equal to or lower than the softening point of the ink absorbing layer, the sticking of the sheet to the heat roller 9 and the pressure roller 10 is further restrained.

Then, the controller 101 determines whether or not the sheet has passed the drying device (step S5 in the flowchart of FIG. 9). When the sheet has not passed the drying device (NO in step S5 in the flowchart of FIG. 9), step S5 is repeated until it is determined that the sheet has passed the drying device. On the other hand, when the sheet has passed the drying device (YES in step S5 in the flowchart of FIG. 9), the controller 101 then determines whether or not there is any subsequent sheet to be conveyed (step S6 in the flowchart of FIG. 9). When there is a subsequent sheet to be conveyed (YES in step S6 in the flowchart of FIG. 9), the above steps in the flowchart are repeated until it is determined that there is no subsequent sheet in step S6 in the flowchart of FIG. 9. On the other hand, when there is no subsequent sheet to be conveyed (NO in step S6 in the flowchart of FIG. 9), the image forming operation ends.

Next, a description is given of the example of the temperature control of the heater 19 based on the total amount of ink discharged from the liquid discharge head 14.

Figure 10:
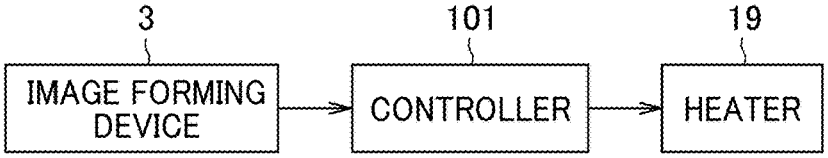
FIG. 10 is a block diagram illustrating another control system that is different from the control system of FIG. 8.

FIG. 10 is a block diagram illustrating another control system that is different from the control system of FIG. 8.

Figure 11:
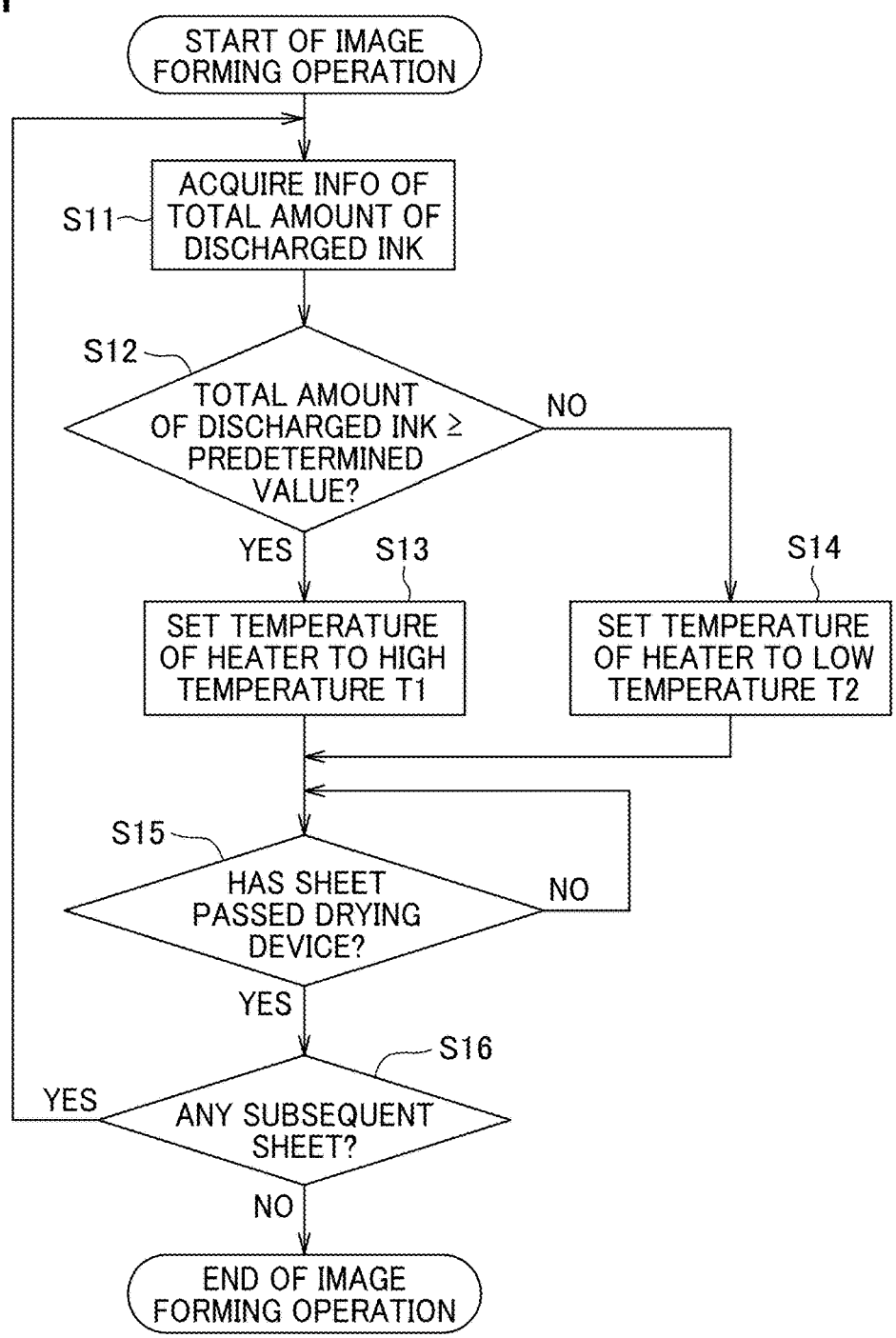
FIG. 11 is a flowchart of another control flow that is different from the control flow of FIG. 9.

FIG. 11 is a flowchart of another control flow that is different from the control flow of FIG. 9.

As illustrated in FIG. 10, in the image forming apparatus 100 in this example, the controller 101 controls the temperature of the heater 19 based on the total amount of ink discharged from the image forming device 3 instead of the input unit 102.

Therefore, in this example, as an image formation command is issued to start the image forming operation, the controller 101 acquires image formation of the total amount of ink discharged from the image forming device 3 to the sheet (step S11 in the flowchart of FIG. 11), and determines whether the total amount of ink discharged from the image forming device 3 is equal to or greater than the predetermined value (step S12 in the flowchart of FIG. 11).

As a result, when the total amount of ink discharged from the image forming device 3 is equal to or greater than the predetermined value (YES in step S12 in the flowchart of FIG. 11), it is determined that the amount of ink applied to the sheet is relatively large (in other words, greater than the predetermined amount), and the temperature of the heater 19 is set to the high temperature T1 (step S13 in the flowchart of FIG. 11). Consequently, the surface temperature of the heat roller 9 and the surface temperature of the pressure roller 10 (that is, the temperatures of the respective sheet holding faces that hold the sheet) are controlled to be higher than the softening point of the ink absorbing layer (resin surface).

On the other hand, when the controller 101 has determined that the total amount of ink discharged from the image forming device 3 is smaller than the predetermined value (NO in step S12 in the flowchart of FIG. 11), it is determined that the amount of ink applied to the sheet is relatively small (in other words, equal to or smaller than the predetermined amount), and the temperature of the heater 19 is set to the low temperature T2 (step S14 in the flowchart of FIG. 11) as in the above-described example. Consequently, the surface temperature of the heat roller 9 and the surface temperature of the pressure roller 10 (that is, the temperatures of the respective sheet holding faces that hold the sheet) are controlled to be equal to or lower than the softening point of the ink absorbing layer (resin surface).

Thereafter, the sheet is heated at the temperature set according to each case, and the controller 101 determines whether or not the sheet has passed the drying device (step S15 in the flowchart of FIG. 11). When the sheet has not passed the drying device (NO in step S15 in the flowchart of FIG. 11), step S15 is repeated until it is determined that the sheet has passed the drying device. On the other hand, when the sheet has passed the drying device (YES in step S15 in the flowchart of FIG. 11), the controller 101 then determines whether or not there is any subsequent sheet to be conveyed (step S16 in the flowchart of FIG. 11). Then, when there is a subsequent sheet to be conveyed (YES in step S16 in the flowchart of FIG. 11), the above steps in the flowchart are repeated until it is determined that there is no subsequent sheet in step S16 in the flowchart of FIG. 11. On the other hand, when there is no subsequent sheet to be conveyed (NO in step S16 in the flowchart of FIG. 11), the image forming operation ends.

As described above, also in the example illustrated in FIGS. 10 and 11, when it is determined that the amount of ink applied to the sheet is relatively large, the controller 101 causes the surface temperature of the heat roller 9 and the surface temperature of the pressure roller 10 to be a relatively high temperature. Accordingly, even if the sheet has a large amount of ink, the sheet is heated effectively, thereby accelerating the drying of the ink on the sheet. Further, when it is determined that the amount of ink applied to the sheet is relatively small, the surface temperature of the heat roller 9 and the surface temperature of the pressure roller 10 are controlled to be equal to or lower than the softening point of the ink absorbing layer, and therefore the sticking of the sheet to the heat roller 9 and the pressure roller 10 is further restrained.

Next, a description is given of the example of the speed control of the conveying speed of the sheet that passes the drying device, in addition to the temperature control of the heater.

Figure 12:
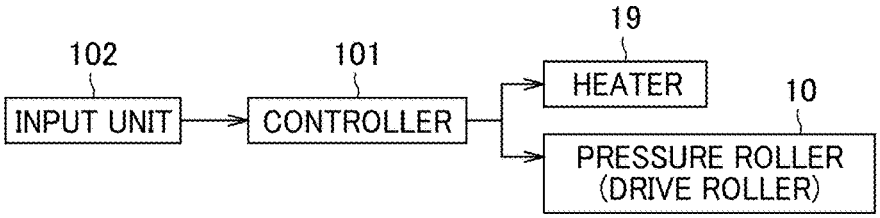
FIG. 12 is a block diagram illustrating yet another control system that is different from the control systems of FIGS. 8 and 10.

FIG. 12 is a block diagram illustrating yet another control system that is different from the control systems of FIGS. 8 and 10.

Figure 13:
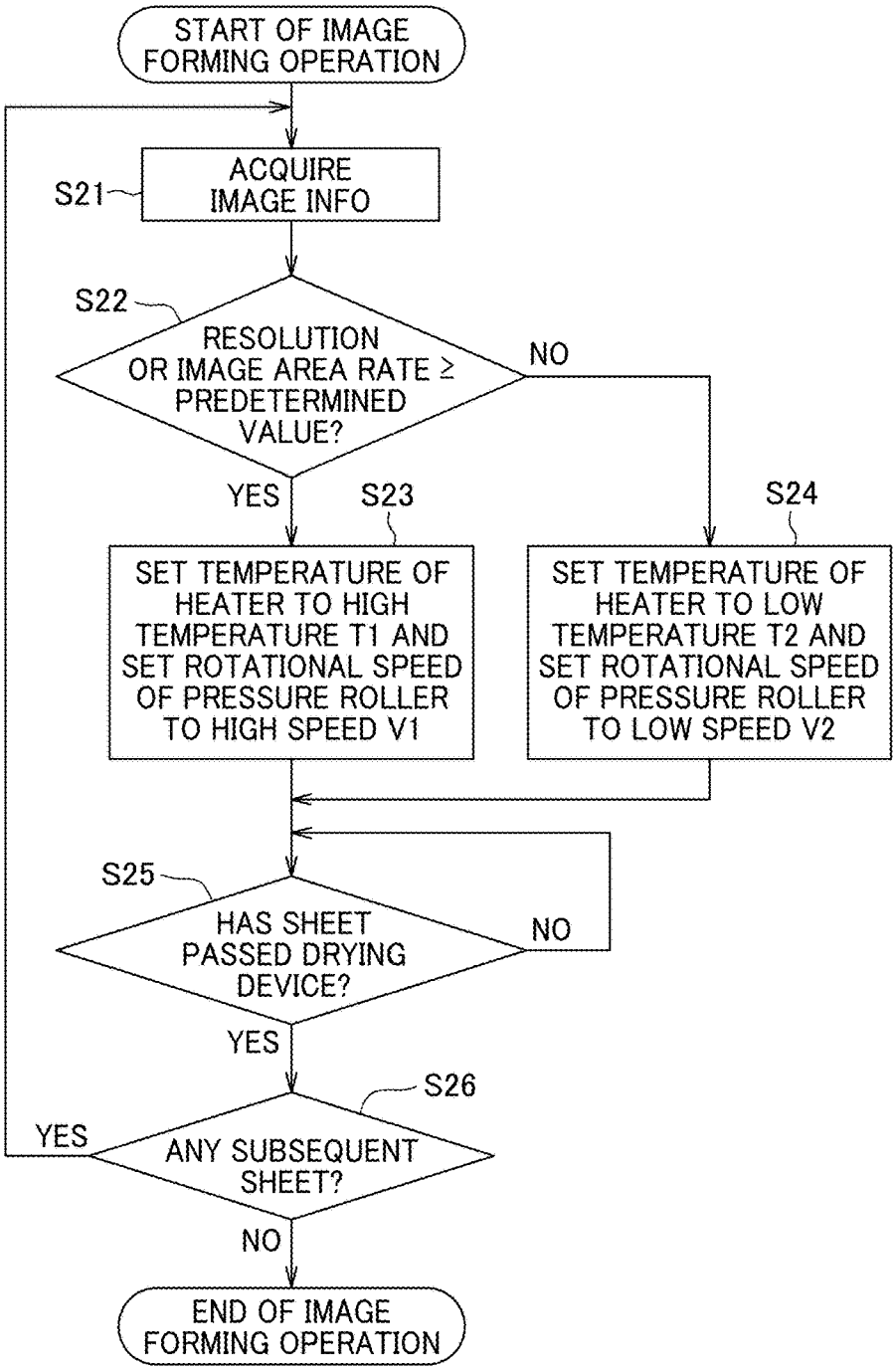
FIG. 13 is a flowchart of yet another control flow that is different from the control flows of FIGS. 9 and 11.

FIG. 13 is a flowchart of yet another control flow that is different from the control flows of FIGS. 9 and 11.

As illustrated in FIG. 12, in the image forming apparatus 100 in this example, the controller 101 controls the rotational speed of the pressure roller 10 that functions as a drive roller in addition to the temperature of the heater 19. That is, the control of the rotational speed of the pressure roller 10 changes the conveying speed of the sheet when the sheet is conveyed by the pressure roller 10 and the heat roller 9. Note that, while the controller 101 controls the heater 19 and the pressure roller 10 based on the image information input from the image reading device 2 or the input unit 102 of a terminal device in FIG. 12, the controller 101 may controls the heater 19 and the pressure roller 10 based on the total amount of ink discharged from the image forming device 3 instead of the input unit 102.

In this case, as an image formation command is issued to start the image forming operation, the controller 101 acquires image formation from the input unit 102 (step S21 in the flowchart of FIG. 13), and determines whether the image resolution or the image area rate of the image acquired from the image formation is equal to or greater than the predetermined value (step S22 in the flowchart of FIG. 13).

As a result, when the image resolution or the image area rate is equal to or higher than the predetermined value (YES in step S22 in the flowchart of FIG. 13), it is determined that the amount of ink applied to the sheet is relatively large (in other words, greater than the predetermined amount), and the temperature of the heater 19 is set to the high temperature T1 (step S23 in the flowchart of FIG. 13) as in the above-described example. Consequently, the surface temperature of the heat roller 9 and the surface temperature of the pressure roller 10 (that is, the temperatures of the respective sheet holding faces that hold the sheet) are controlled to be higher than the softening point of the ink absorbing layer (resin surface). Further, at this time, the rotational speed of the pressure roller 10 is set to a relatively high speed V1 (step S23 in the flowchart of FIG. 13).

On the other hand, when the image resolution or the image area rate is smaller than the predetermined value (NO in step S22 in the flowchart of FIG. 13), it is determined that the amount of ink applied to the sheet is relatively small (in other words, equal to or smaller than the predetermined amount), and the temperature of the heater 19 is set to the low temperature T2 (step S24 in the flowchart of FIG. 13) as in the above-described example. Consequently, the surface temperature of the heat roller 9 and the surface temperature of the pressure roller (that is, the temperatures of the respective sheet holding faces that hold the sheet) are controlled to be equal to or lower than the softening point of the ink absorbing layer (resin surface). Further, at this time, the rotational speed of the pressure roller 10 is set to a relatively low speed V2 (step S24 in the flowchart of FIG. 13) that is lower than the high speed V1. In other words, the rotational speed of the pressure roller 10 as the sheet P passes between the heat roller 9 and the pressure roller 10 is lower when the surface temperature of the sheet holding face 9*a* of the heat roller 9 and the surface temperature of the sheet holding face 10*a* of the pressure roller 10 are equal to or lower than the softening point of the ink absorbing layer (resin surface), than when the surface temperature of the sheet holding face 9*a* of the heat roller 9 and the surface temperature of the sheet holding face 10*a* of the pressure roller 10 are higher than the softening point of the ink absorbing layer (resin surface).

Thereafter, the sheet is heated at the temperature set according to each case, and the controller 101 determines whether or not the sheet has passed the drying device (step S25 in the flowchart of FIG. 13). When the sheet has not passed the drying device (NO in step S25 in the flowchart of FIG. 13), step S25 is repeated until it is determined that the sheet has passed the drying device. On the other hand, when the sheet has passed the drying device (YES in step S25 in the flowchart of FIG. 13), the controller 101 then determines whether or not there is any subsequent sheet to be conveyed (step S26 in the flowchart of FIG. 13). Then, when there is a subsequent sheet to be conveyed (YES in step S26 in the flowchart of FIG. 13), the above steps in the flowchart are repeated until it is determined that there is no subsequent sheet in step S26 in the flowchart of FIG. 13. On the other hand, when there is no subsequent sheet to be conveyed (NO in step S26 in the flowchart of FIG. 13), the image forming operation ends.

As described above, in the example illustrated in FIGS. 12 and 13, when it is determined that the amount of ink applied to the sheet is relatively small, the surface temperature of the heat roller 9 and the surface temperature of the pressure roller 10 are controlled to be equal to or lower than the softening point of the ink absorbing layer, and therefore the sticking of the sheet to the heat roller 9 and the pressure roller 10 is further restrained, as in the above-described example. However, on the other hand, the amount of heat applied to the sheet per unit time is reduced, it becomes difficult to dry the ink on the sheet. By contrast, in the example illustrated in FIGS. 12 and 13, the rotational speed of the pressure roller 10 is decreased to lower the conveying speed of the sheet. By so doing, the heating time to heat the sheet is increased, thereby accelerating the drying of the ink on the sheet. On the other hand, when it is determined that the amount of ink applied to the sheet is relatively large, the sheet is dried at a relatively high temperature. Therefore, even if the rotational speed of the pressure roller 10 is increased, the drying of the ink on the sheet is accelerated. Further, by increasing the rotational speed of the pressure roller 10, the productivity (that is, the number of output images per unit time) is enhanced. As described above, according to the example illustrated in FIGS. 12 and 13, controlling both the temperature of the heater 19 and the rotational speed of the pressure roller 10 restrains the sticking of the sheet to the heat roller 9 and the pressure roller 10 and provides the heating time to heat the sheet according to the amount of ink applied to the sheet.

In the examples illustrated in FIGS. 8 to 13, the surface temperature of the heat roller 9 and the surface temperature of the pressure roller 10 are set to the temperature equal to or lower than the temperature of the ink absorbing layer when the amount of ink applied to the sheet (in other words, equal to or smaller than the predetermined amount). However, if the drying speed of ink and the productivity are less considered, also in a case in which the amount of ink applied to the sheet is relatively large (that is, greater than the predetermined amount), the surface temperature of the heat roller 9 and the surface temperature of the pressure roller 10 may be set to be equal to or lower than the softening point of the ink absorbing layer. That is, by setting the heating temperature to be basically equal to or lower than the softening point of the ink absorbing layer regardless of the amount of ink applied to the sheet, the softening of the ink absorbing layer is restrained, and therefore the sticking of the sheet to the heat roller 9 and the pressure roller 10 is restrained. In that case, the heat roller 9 and the pressure roller 10 may not employ the above-described knurled roller 55.

Further, even in the above-described configuration in which the heating temperature is set to be basically equal to or lower than the softening point of the ink absorbing layer, as in the example illustrated in FIGS. 8 and 9 and the example illustrated in FIGS. 10 and 11, the surface temperature of the heat roller 9 and the surface temperature of the pressure roller 10 (i.e., the temperatures of the sheet holding faces 9*a* and 10*a*) may be further lower when the amount of ink applied to the sheet is relatively small, than when the amount of ink applied to the sheet is relatively large. Further, as in the example illustrated in FIGS. 12 and 13, the rotational speed of the pressure roller 10 may be lower when the surface temperature of the heat roller 9 and the surface temperature of the pressure roller 10 are set to be relatively low, than when the surface temperature of the heat roller 9 and the surface temperature of the pressure roller 10 are relatively high. Accordingly, when the amount of ink applied to the sheet is relatively small, the sticking of the sheet to the heat roller 9 and the pressure roller 10 is further restrained. However, in this case, it is assumed that the above-mentioned temperatures T1 and T2, which are set as the surface temperature of the heat roller 9 and the surface temperature of the pressure roller 10, are both set to be equal to or lower than the softening point of the ink absorbing layer.

As described above, the above-described configurations according to the embodiments of the present disclosure are applied but may not limited to the drying device having the configuration as illustrated in FIG. 2. For example, the present disclosure may be applicable to a drying device having a different configuration.

Next, a description is given of another drying device according to the present disclosure.

Figure 14:
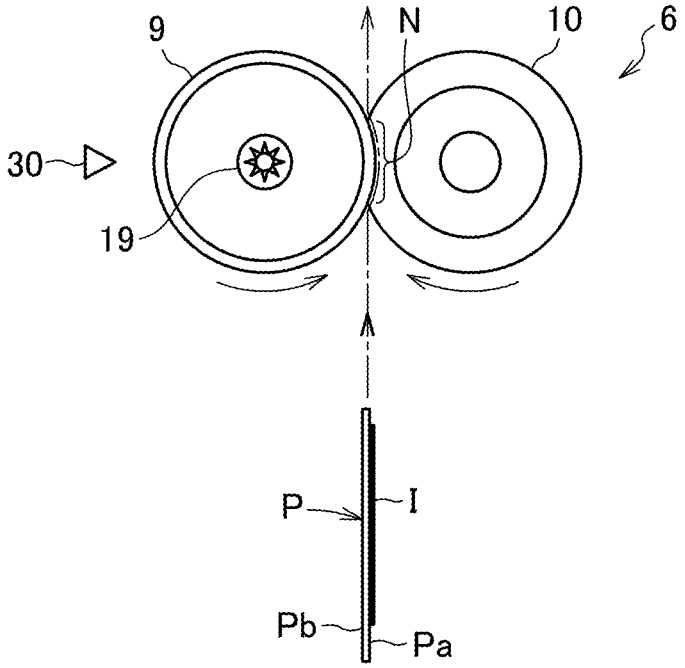
FIG. 14 is a diagram illustrating an example in which the position of a heat roller and the position of a pressure roller are reversed from the positions in the drying device of FIG. 2.

FIG. 14 is a diagram illustrating an example in which the position of the heat roller 9 and the position of the pressure roller 10 are reversed from the positions in the drying device 6 of FIG. 2.

Figure 15:
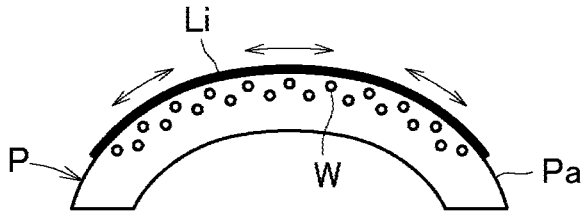
FIG. 15 is a diagram for explaining the principle of generation of a back curl on a sheet.

FIG. 15 is a diagram for explaining the principle of generation of a back curl on a sheet.

Figure 16:
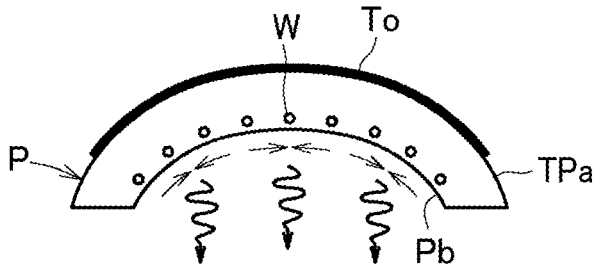
FIG. 16 is a diagram for explaining the principle of generation of another back curl on a sheet.

FIG. 16 is a diagram for explaining the principle of generation of another back curl on a sheet.

As illustrated in FIG. 14, the respective positions of the heat roller 9, the pressure roller 10, the heater 19, and the temperature sensor 30 are reversed from the positions in the drying device 6 of FIG. 2. Except for the above-described positions, the drying device 6 illustrated in FIG. 14 basically has the configuration identical to the configuration of the drying device 6 illustrated in FIG. 2.

In the case of the drying device 6 illustrated in FIG. 14, as the sheet P on which the ink I is applied enters the nip region N between the heat roller 9 and the pressure roller 10, the sheet P is heated mainly from the opposite face Pb opposite the liquid applied face (image forming surface) on which the ink I is applied. That is, the sheet P is heated from the opposite face Pb that contacts the heat roller 9 that is heated by the heater 19.

As described above, in the drying device 6 illustrated in FIG. 14, the sheet P is heated from the opposite face Pb that is opposite the liquid applied face Pa, thereby restraining generation of back curl on the sheet P.

Hereinafter, a description is given of the principle of back curl generation and the effect of restraining the back curl.

Generally, in a case of a plain paper, when liquid Li is applied to one side, that is, the liquid applied face Pa of the sheet P as illustrated in FIG. 15, water W in the liquid Li stretches fabric on the liquid applied face Pa of the sheet P in a specified direction, which generates a curl. More specifically, the water W permeates between the cellulose fibers of the sheet P and breaks the hydrogen bond of the cellulose fibers. By so doing, the intervals of the cellulose fibers increase, and therefore the sheet P extends in the specified direction. As a result, the sheet P warps upward to cause the image forming surface (liquid applied face Pa) to have a curl in a convex shape. The curl is referred to as a back curl.

Further, in an electrophotographic image forming apparatus that forms an image with toner, as the toner applied face of the sheet is heated to fix the toner to the sheet, a curl similar to the back curl may be generated. To be more specific, as illustrated in FIG. 16, when the image forming surface (toner applied face TPa) of the sheet P, to which toner To is applied, is heated with the higher temperature, the water content of the water W originally contained in the sheet P increases to be higher on the opposite face Pb than on the toner applied face TPa. As a result, the shrinkage of the sheet P caused by the subsequent drying after heating is more remarkable on the opposite face Pb than on the toner applied face TPa. This shrinkage causes the image forming surface (toner applied face TPa) of the sheet P to warp upward in a convex shape to generate a back curl.

That is, on the contrary to the example of a back curl illustrated in FIG. 16, in the drying device 6 illustrated in FIG. 14, the sheet P is heated from the opposite face Pb that is opposite the image forming surface (liquid applied face Pa) of the sheet P. That is, on the contrary to example of the back curl illustrated in FIG. 16, the opposite face Pb of the sheet P is heated at the temperature higher than the temperature of the liquid applied face Pa of the sheet P. Therefore, a force is exerted in the opposite direction to a force applied to the sheet P to generate the back curl. Accordingly, the drying device 6 illustrated in FIG. 14 restrains generation of back curl, thereby reducing or eliminating inconveniences such as a conveyance failure by the sheet having a back curl and a decrease in the number of sheets stackable in the sheet ejection tray.

Further, such an effect of restraining back curl is similarly obtained when drying the image on the back face of the sheet P in the duplex printing. That is, in a case in which the image formed on the back face of the sheet P is dried, the sheet P is heated from the opposite face Pb (front face) opposite the liquid applied face Pa (back face), so that the force is exerted in the opposite direction to the force that generates a back curl to the sheet P. Note that, since ink is applied to both the front and back faces of the sheet P in the duplex printing, both faces may be the "liquid applied face." However, the "liquid applied face" referred to in the description of the present disclosure represents the face on which liquid is applied (front face) when the sheet P has the liquid on a single face or the face on which liquid is applied for the second time (back face) when the sheet P has the liquid on both the front and back faces.

Figure 17:
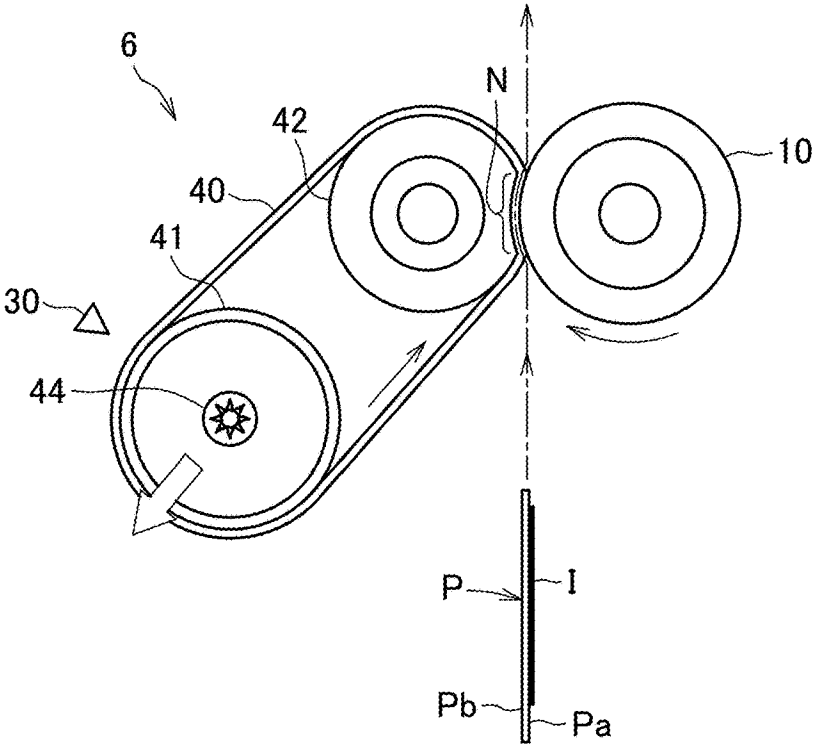
FIG. 17 is a diagram illustrating an example in which the drying device includes a heat belt.

FIG. 17 is a diagram illustrating an example in which the drying device 6 includes a heat belt as a heating member to heat the sheet.

To be more specific, the drying device 6 illustrated in FIG. 17 includes a heat belt 40, a tension roller 41, a fixed roller 42, the pressure roller 10, a heater 44, and the temperature sensor 30.

The heat belt 40 is a heating member to heat the sheet P while being in contact with the sheet P. In the present embodiment, the heat belt 40 includes an endless belt base having flexibility, an elastic layer formed on the outer circumferential surface of the belt base, and a release layer formed on the outside of the elastic layer. Note that the belt base may have a single layer. The belt base of the heat belt 40 is constructed of a heat resistant resin, made of polyimide I), has an outer diameter of 100 mm and a thickness in a range of from 10 μm to 70 μm, for example. The elastic layer is made of silicone rubber and has a thickness of in a range of from 100 μm to 300 μm, for example. The release layer is constructed of a fluororesin, for example. Further, the heat belt 40 is rotatably supported by the tension roller 41 and the fixed roller 42 while being wound around the tension roller 41 and the fixed roller 42.

The tension roller 41 and the fixed roller 42 are belt supports each rotatably supporting the heat belt 40. The tension roller 41 is movable inside the loop of the heat belt and is pressed against the inner circumferential surface of the heat belt 40 by a biasing member such as a spring. On the other hand, the fixed roller 42 is fixed so as not to move.

The pressure roller 10 is a pressing member that is pressed against the fixed roller 42 via the heat belt 40. The pressure roller 10 is in contact with the outer circumferential surface of the heat belt 40. Thus, the nip region N is formed between the pressure roller 10 and the heat belt 40. The structure of the pressure roller 10 is substantially the same as the configuration of the heat roller illustrated in FIG. 2.

The heater 44 is a heat source to heat the heat belt 40. In the present embodiment, the heater 44 is disposed inside the tension roller 41. Therefore, as the heater 44 generates heat, the heat is transmitted to the heat belt 40 via the tension roller 41, so that the heat belt 40 is heated. Accordingly, the tension roller 41 in the present embodiment functions as a heating member (heat rotator) to heat the heat belt 40 with the heat generated by the heater 44 disposed inside the tension roller 41. In the present embodiment, a halogen heater is used as the heater 44. Further, a heat source that heats the heat belt 40 may be a radiant-heat-type heater that emits infrared rays such as a halogen heater or a carbon heater, or an electromagnetic-induction-type heat source.

Further, the temperature sensor 30 functions as a temperature detector to detect the surface temperature of the heat belt 40, in other words, the temperature of the outer circumferential surface of the heat belt 40. By controlling the output of the heater 44 based on the surface temperature of the heat belt 40 detected by the temperature sensor 30, the surface temperature of the heat belt 40 is controlled to be a desired temperature (fixing temperature).

In the drying device 6 illustrated in FIG. 17, the pressure roller 10 rotates in the direction indicated by arrow in FIG. 17 (that is, a clockwise direction). By so doing, the heat belt 40, the tension roller 41, and the fixed roller 42 are rotated together with the rotation of the pressure roller 10. Note that the tension roller 41 and the fixed roller 42 each may be function as a drive roller. Further, the heater 44 generates heat to heat the heat belt 40 via the tension roller 41. The heater 44 is controlled to maintain the temperature of the heat belt within a range, for example, from 100° C. to 180° C.

In this state, as illustrated in FIG. 17, as the sheet P on which the (liquid) ink I is applied is conveyed to the drying device 6, the sheet P enters (the nip region N) between the heat belt 40 and the pressure roller 10, so that the sheet P is held and conveyed by the heat belt 40 and the pressure roller 10. At this time, the sheet P is heated mainly by application of heat of the heat belt 40 and is ejected from the nip region N between the heat belt 40 and the pressure roller 10.

As described above, since the drying device 6 illustrated in FIG. 17 heats the sheet P mainly by heat from the heat belt 40, the sheet P is heated from the opposite face Pb that is opposite the image forming surface (liquid applied face Pa) of the sheet P, similar to the drying device 6 illustrated in FIG. 16. Accordingly, the force is exerted in the opposite direction opposite the direction of the force to generate a back curl on the sheet P, thereby restraining generation of a back curl.

Figure 18:
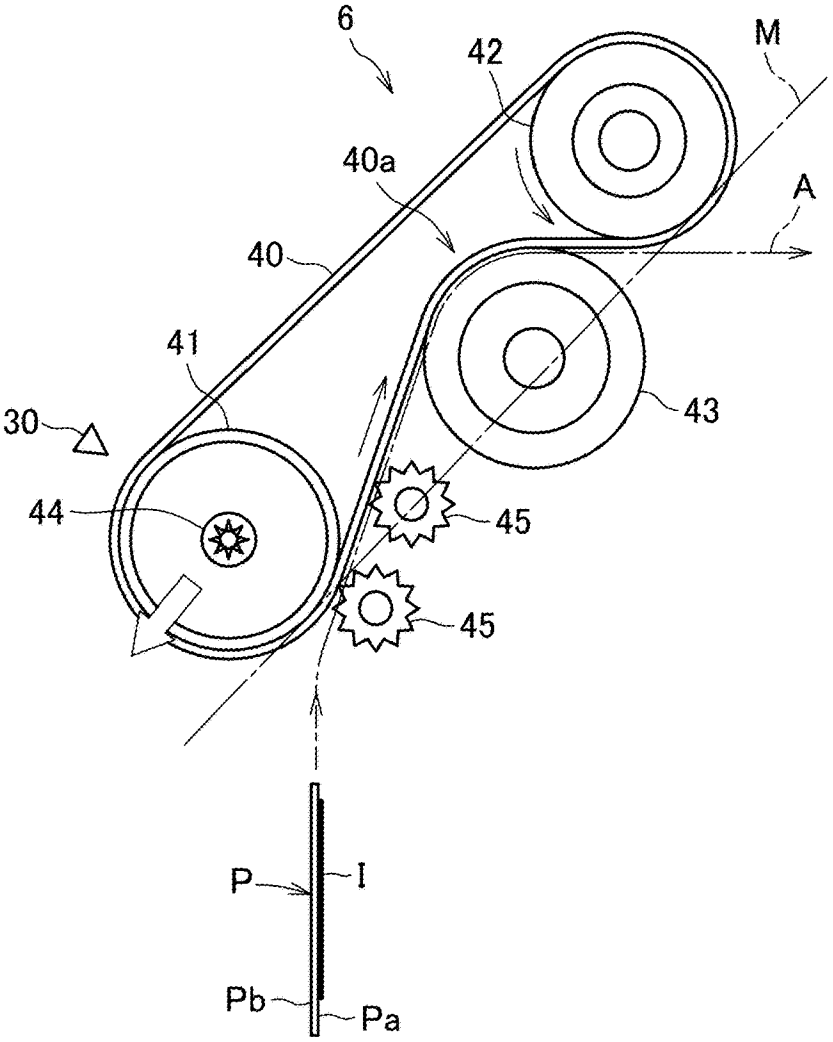
FIG. 18 is a diagram illustrating an example in which the drying device includes a pressure roller pressing the heat belt.

FIG. 18 is a diagram illustrating an example in which the drying device 6 includes a pressure roller pressing the heat belt 40.

The drying device 6 illustrated in FIG. 18 includes the heat belt 40, the tension roller 41, the fixed roller 42, the heater 44, the temperature sensor 30, a pressure roller 43, and a plurality of spur wheels 45. However, the heat belt 40 has an outer diameter (for example, 150 mm) that is greater than the outer diameter of the heat belt 40 illustrated in FIG. 17.

The pressure roller 43 functions as a pressing member that presses the outer circumferential surface of the heat belt 40 between the tension roller 41 and the fixed roller 42. The pressure roller 43 is pressed against the heat belt 40 by a force applying member such as a spring and a cam, toward the inside of the heat belt 40, in other words, toward the inside of the loop of the heat belt 40, from a common tangent line M that contacts the outer circumferential surface of the tension roller 41 and the outer circumferential surface of the fixed roller 42. The pressure roller 43 presses the outer circumferential surface of the heat belt 40 toward the inside of the heat belt 40, so that the heat belt 40 has a curved portion 40*a* that warps (curves) along the outer circumferential surface of the pressure roller 43.

Each spur wheel 45 functions as a projecting rotator having a plurality of projections projecting radially outward.

Figure 19:
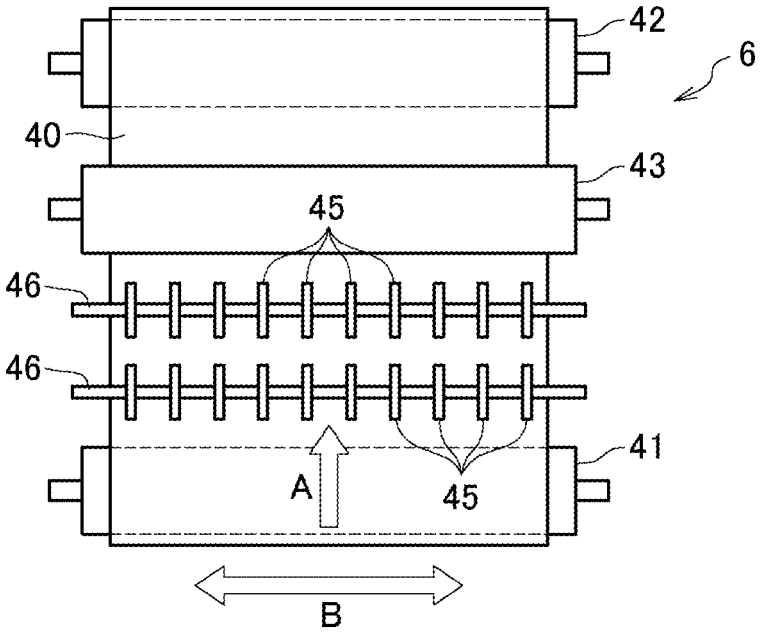
FIG. 19 is a plan view illustrating the drying device indicating the arrangement of the spur wheels.

Further, FIG. 19 is a plan view illustrating the drying device 6 indicating the arrangement of the spur wheels 45.

Figure 20:
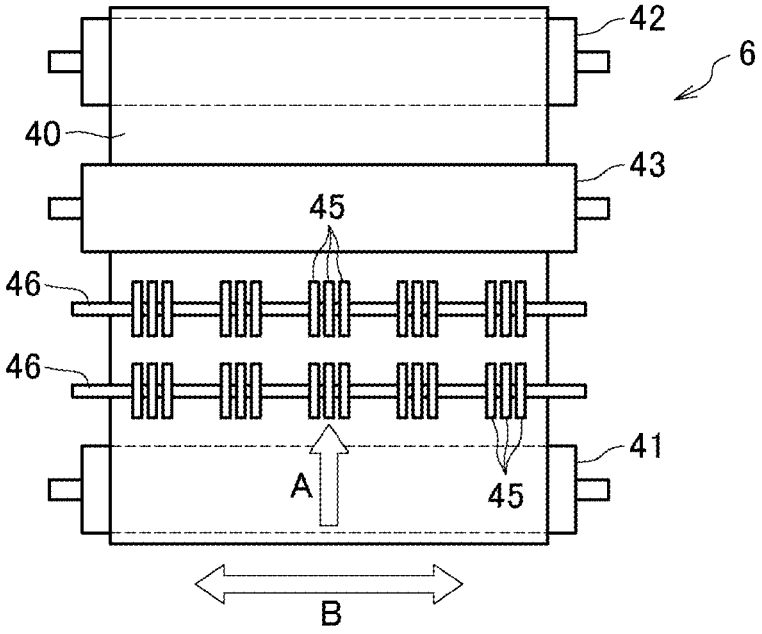
FIG. 20 is a plan view illustrating the drying device indicating another arrangement of the spur wheels.

FIG. 20 is a plan view illustrating the drying device 6 indicating another arrangement of the spur wheels 45.

In the present embodiment, as illustrated in FIG. 19, a plurality of support shafts 46 are disposed along the sheet conveyance direction A. Further, the spur wheels 45 (plurality of spur wheels 45) are mounted on each of the plurality of support shafts 46, at equal intervals in the belt width direction indicated by arrow B in FIG. 19 or the axial direction of each support shaft 46. Here, the "belt width direction" represents a direction intersecting the sheet conveyance direction A along the outer circumferential surface of the heat belt 40. Further, as illustrated in FIG. 20, the drying device 6 may include the spur wheel groups, in each of which the plurality of spur wheels 45 are disposed closely to each other, may be disposed at equal intervals over the belt width direction B. Further, the spur wheels 45 may be disposed at different intervals over the belt width direction B. Alternatively, the spur wheel 45 on the upstream side and the spur wheel 45 on the downstream side in the sheet conveyance direction A may not be at the same position in the sheet conveyance direction A but may be shifted from each other in the belt width direction B.

In the drying device 6 illustrated in FIG. 18, as the fixed roller 42 rotates in the direction indicated by arrow in FIG. 18 (that is, the counterclockwise direction), the heat belt is rotated along with the rotation of the fixed roller 42, and the tension roller 41, the pressure roller 43, and the spur wheels 45 are rotated together with the rotation of the heat belt 40. Further, the heater 44 generates heat to heat the heat belt 40 via the tension roller 41, and the temperature of the heat belt 40 is maintained at the predetermined target temperature.

In this state, as illustrated in FIG. 18, as the sheet P on which a liquid ink I is applied is conveyed to the drying device 6, the sheet P first enters between the heat belt 40 and each of the spur wheels 45, so that the sheet P is conveyed by the heat belt 40 while the heat belt 40 rotates. At this time, the sheet P is heated by the heat belt 40, mainly from the opposite face Pb that is opposite the liquid applied face Pa of the sheet P. By so doing, the force is exerted in the opposite direction opposite the direction to which the force is applied to the sheet P to generate the above-described back curl.

Then, as the sheet P enters the nip region formed between the pressure roller 43 and the heat belt 40, the sheet P is conveyed by the pressure roller 43 and the heat belt 40 while the pressure belt 48 and the heat belt 40 are holding the sheet P. At this time, the sheet P is heated by the heat belt 40 from the opposite face Pb opposite the liquid applied face Pa and is conveyed while being warped so that the liquid applied face Pa forms a concave shape when the sheet P passes the curved portion 40*a* of the heat belt 40. That is, by passing through the curved portion 40*a* of the heat belt 40, the sheet P is warped in the direction opposite the back curl direction (the warping direction in which the liquid applied face Pa has the convex shape, in other words, the outwardly warped shape) over the sheet conveyance direction A.

As described above, in the drying device 6 illustrated in FIG. 18, the sheet P is heated from the opposite face Pb that is opposite the liquid applied face Pa and is further warped in the direction opposite the back curl direction, thereby effectively restraining generation of back curl on the sheet P.

Further, since the plurality of spur wheels 45 is disposed upstream from the pressure roller 43 in the sheet conveyance direction A in the drying device 6 illustrated in FIG. 18, the sheet P is guided by the plurality of spur wheels 45 before the sheet P reaches the pressure roller 43. At this time, even if the ink applied on the sheet P is in the liquid state, since the contact area of the spur wheel 45 or the plurality of spur wheels 45 to the liquid applied face Pa is smaller than the contact area of a generally used sheet conveying roller, ink smudge on the sheet P caused by the contact of the spur wheel 45 or the plurality of spur wheels 45 to the sheet P is prevented. Further, application of ink to the spur wheel 45 is reduced, so as to restrain the sheet from smear caused by ink being applied from the spur wheel 45 to another sheet.

Further, since the sheet P is guided by the spur wheel 45 to contact the heat belt 40, the sheet P contacts the heat belt 40 before reaching the pressure roller 43, which accelerates the drying of ink on the sheet P. Accordingly, when the sheet P contacts the pressure roller 43, distortion in the image is restrained. Further, after the sheet P has reached the pressure roller 43, the pressure roller 43 presses the sheet P against the heat belt 40 so that the sheet P closely contacts the heat belt 40. Accordingly, the heat is effectively supplied to the sheet P due to the close contact of the sheet P to the heat belt 40, and therefore the drying of the ink on the sheet P is further accelerated.

In addition, in the drying device 6 illustrated in FIG. 18, the heater 44 is disposed upstream from the pressure roller 43 (or the curved portion 40*a*) in the sheet conveyance direction A. Therefore, the sheet P is effectively heated on the upstream side from the pressure roller 43 in the sheet conveyance direction A. Accordingly, the drying of the ink on the sheet P is accelerated before the sheet P reaches the pressure roller 43 and ink application to the pressure roller 43 is restrained effectively.

In the drying device 6 illustrated in FIG. 18, the plurality of spur wheels 45 are disposed upstream from the pressure roller 43 in the sheet conveyance direction A. Therefore, as the sheet P is conveyed to the drying device 6 while the sheet P is deformed due to cockling, for example, the plurality of spur wheels 45 conveys the sheet P while holding the sheet P in a flat shape on the heat belt 40. Accordingly, the sheet P enters in a flat shape between the pressure roller 43 and the heat belt 40, thereby restraining occurrence of wrinkles on the sheet P.

Note that the plurality of spur wheels 45 may not contact the outer circumferential surface of the heat belt 40. As long as the sheet P is conveyed while being held in a flat shape without waving on the heat belt 40, the spur wheel 45 or the plurality of spur wheels 45 may be disposed close to the outer circumferential surface of the heat belt 40 (indirectly contacting the outer circumferential surface of the heat belt 40 via a gap). In other words, as long as a good conveyability of sheets is obtained, the spur wheel 45 or the plurality of spur wheels 45 may be in contact with the heat belt 40 or without contacting the heat belt 40.

Further, in the drying device 6 illustrated in FIG. 18, the pressure roller 43 is not pressed against each of the tension roller 41 and the fixed roller 42 via the heat belt 40, in other words, is spaced away from each of the tension roller 41 and the fixed roller 42. That is, the pressure roller 43 contacts the heat belt 40 at the position away from the tension roller 41 and the fixed roller 42 relative to the heat belt 40 in the sheet conveyance direction A. Therefore, occurrence of wrinkles on the sheet P caused by pressing the sheet P strongly is restrained. That is, since no nip region is formed by application of pressure by the pressure roller 43 and another roller on the sheet conveyance passage of the heat belt 40, the sheet P is not strongly pressed (in the nip region) between the rollers, thereby restraining occurrence of wrinkles on the sheet P. Further, the load to be applied to the heat belt 40 when the heat belt is pressed (in the nip region) between the rollers is reduced, thereby enhancing the durability of the heat belt 40 and extending the service life of the heat belt 40. Further, the rotational resistance of the heat belt 40 is also reduced, thereby increasing the efficiency of rotation of the heat belt 40 and saving the driving energy.

Figure 21:
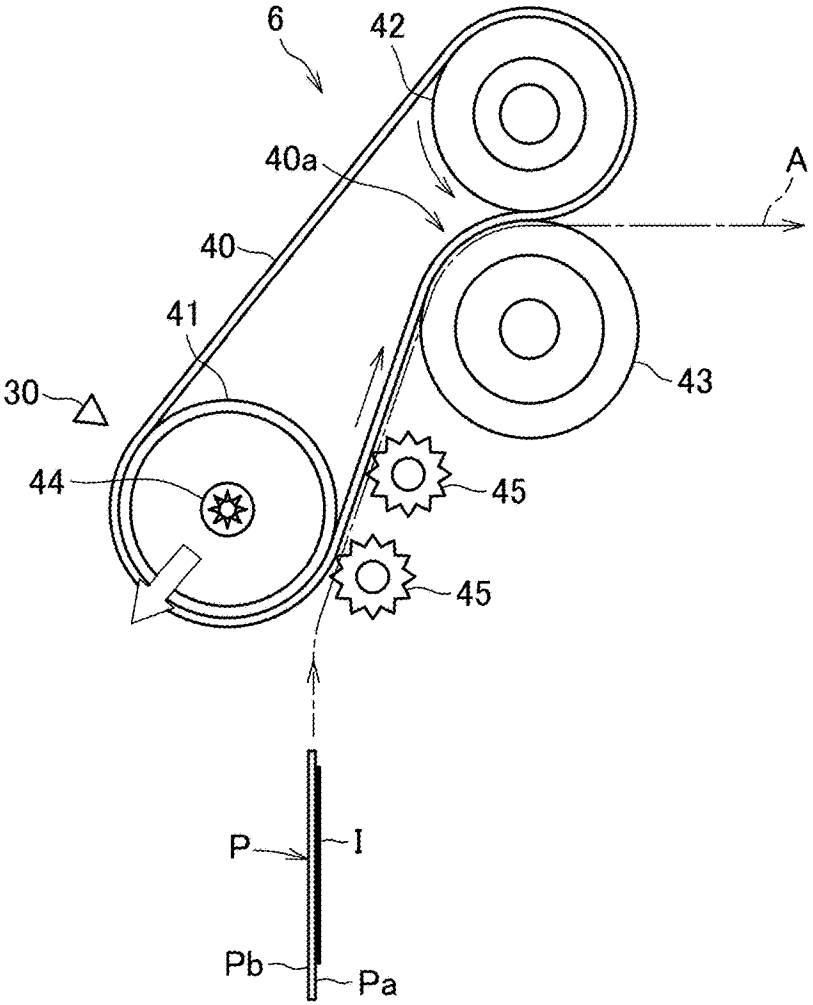
FIG. 21 is a diagram illustrating an example that the pressure roller contacts a fixed roller via the heat belt.

FIG. 21 is a diagram illustrating an example that the pressure roller 43 contacts the fixed roller 42 via the heat belt 40.

Figure 22:
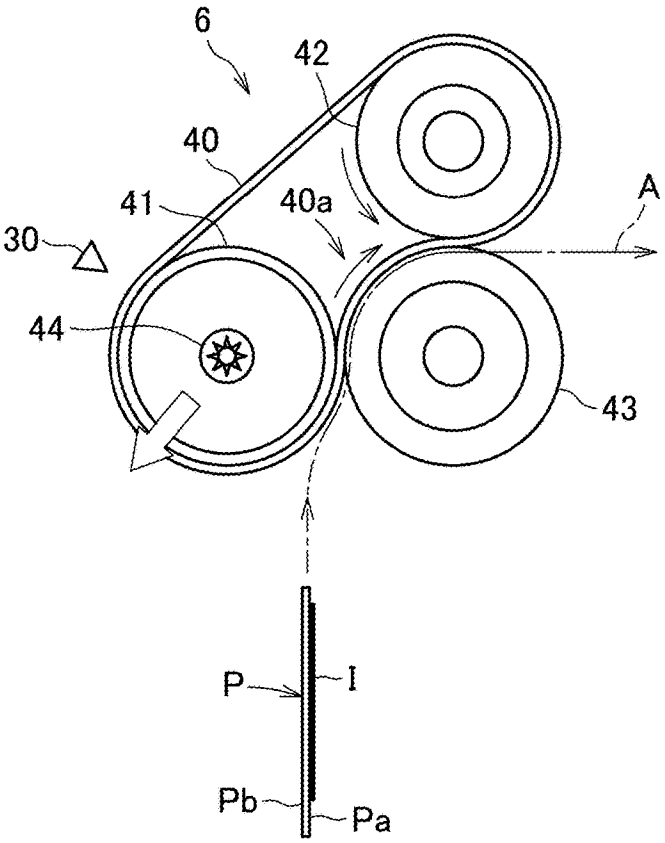
FIG. 22 is a diagram illustrating an example that the pressure roller contacts a tension roller and the fixed roller via the heat belt.

FIG. 22 is a diagram illustrating an example that the pressure roller 43 contacts the tension roller 41 and the fixed roller 42 via the heat belt 40.

As described above, in order to restrain occurrence of wrinkles on the sheet, it is preferable that the pressure roller 43 is not pressed in contact with another roller via the heat belt 40. However, other than this case, in order to restrain deformation of the sheet such as back curl more effectively, the pressure roller 43 may be pressed in contact with the fixed roller 42 via the heat belt 40, as illustrated in FIG. 21.

Further, as illustrated in FIG. 22, the pressure roller 43 may be pressed in contact with each of the tension roller 41 and the fixed roller 42 via the heat belt 40.

Figure 23:
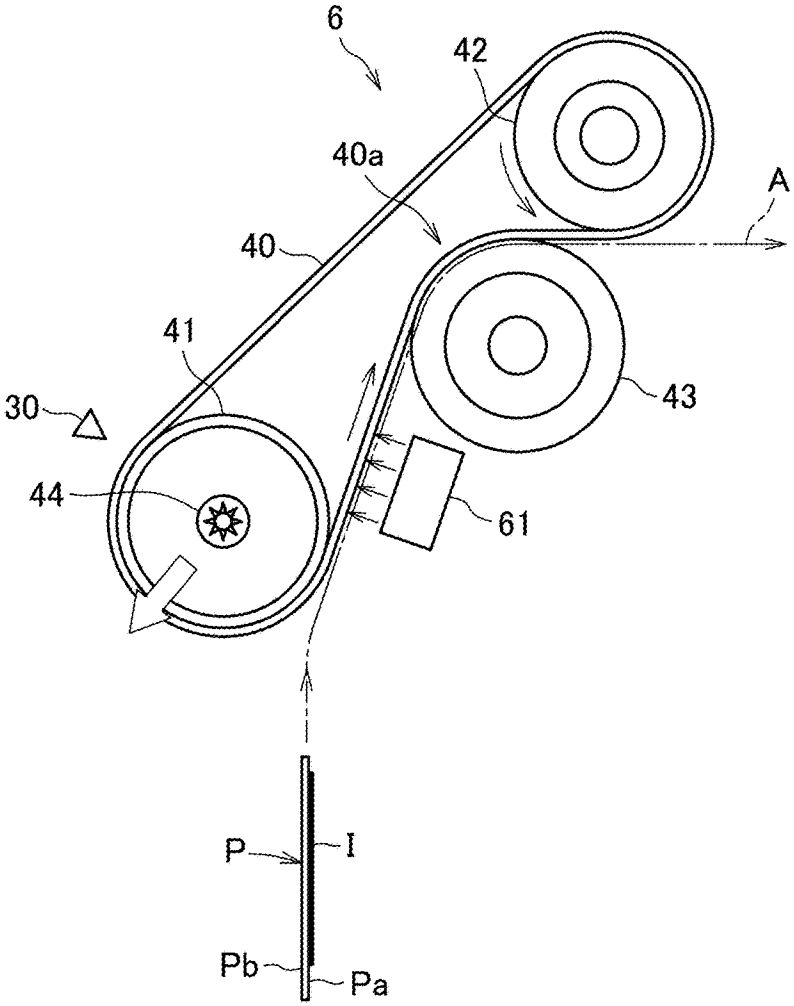
FIG. 23 is a diagram illustrating an example of an air blowing fan instead of the spur wheels.

FIG. 23 is a diagram illustrating an example of an air blowing fan 61 instead of the spur wheels 45.

As illustrated in FIG. 23, instead of the above-described spur wheel 45, the air blowing fan 61 that functions as an air blower may be employed as another device to restrain the image distortion and cause the sheet P to contact the heat belt 40. In this case, the air blowing fan 61 blows air to cause the sheet P to contact the heat belt 40, so that the sheet P is conveyed while being held in a flat shape without being pressed strongly. Further, the air blowing fan 61 may be a warm air blowing fan that blows warm air to restrain the heat belt 40 from being cooled.

Figure 24:
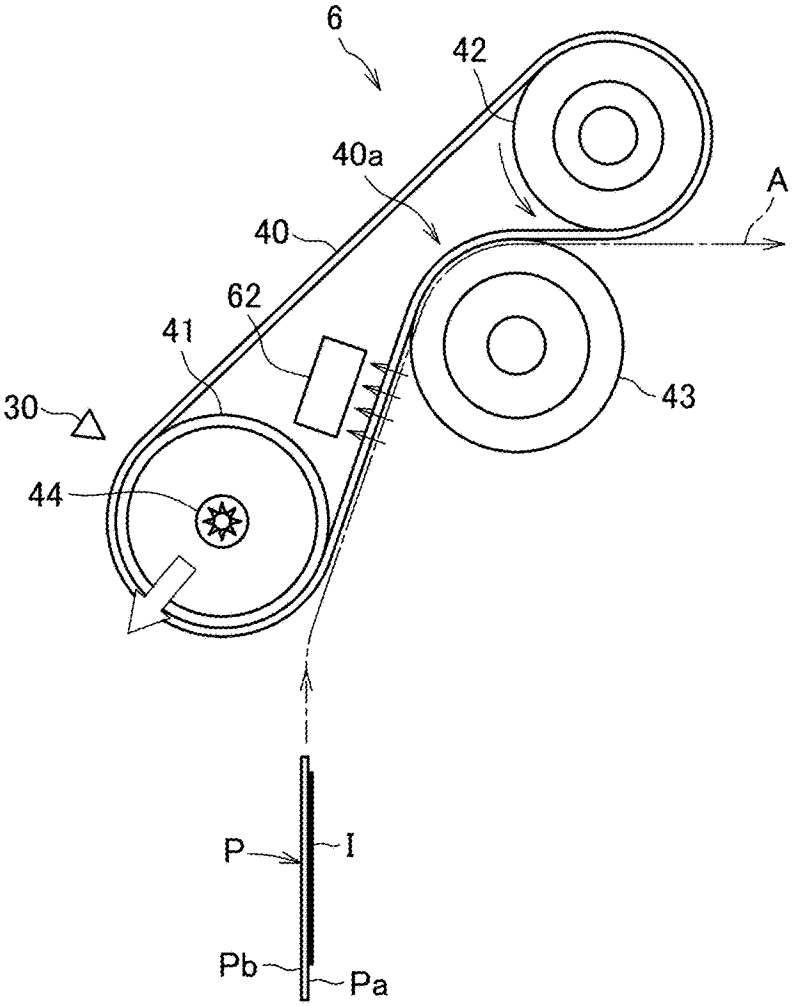
FIG. 24 is a diagram illustrating an example of an air suction fan instead of the spur wheels.

Further, FIG. 24 is a diagram illustrating yet another example of an air suction fan 62 instead of the spur wheels.

To be more specific, as illustrated in FIG. 24, the air suction fan 62 that functions as an air suction member may be disposed inside the loop of the heat belt 40. In this case, the heat belt 40 has a plurality of air holes and the air suction fan 62 sucks air from the plurality of air holes of the heat belt 40. By so doing, the sheet P is attracted to the heat belt 40. In this case, the sheet P is conveyed while being held in a flat shape on the heat belt 40 without being pressed strongly.

Further, in addition to the above-described methods using the air blowing fan 61 and the air suction fan 62, a method by which the heat belt 40 is charged to cause the sheet P to be electrostatically attracted to the charged heat belt 40 may be employed.

Figure 25:
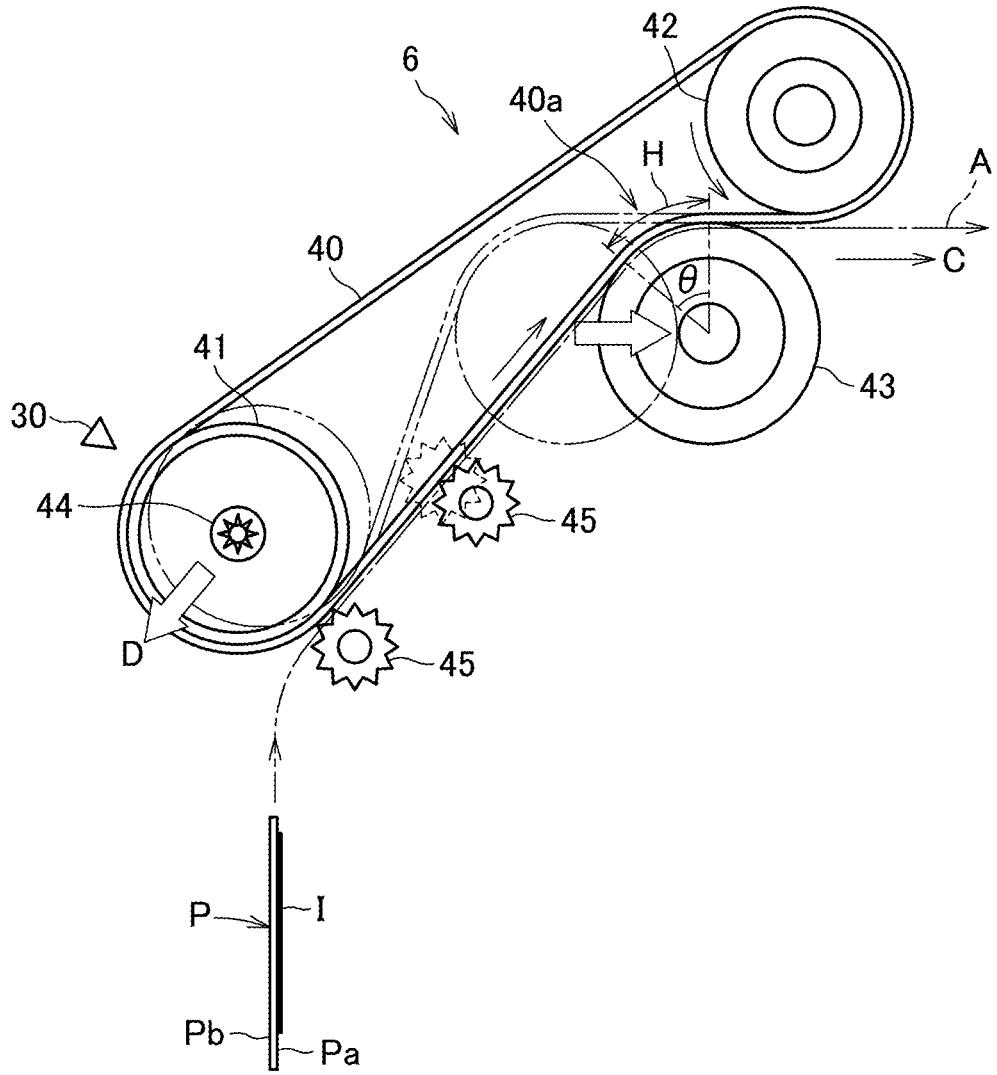
FIG. 25 is a diagram illustrating an example that the winding angle of the heat belt around the pressure roller is changeable.

FIG. 25 is a diagram illustrating an example that the winding angle of the heat belt 40 around the pressure roller 43 is changeable.

As illustrated in FIG. 25, the pressure roller 43 may be moved to make the winding angle (theta) of the heat belt 40 to the pressure roller 43 changeable. Accordingly, the length H of the contact area (curved portion 40*a*) in the sheet conveyance direction A in which the pressure roller 43 and the heat belt 40 contact is changeable.

For example, when an image having a low image area rate with texts, the amount of ink application to the sheet P is relatively small, and therefore it is not likely to generate back curl easily. Therefore, when an image having a low image area rate is formed on the sheet P, as illustrated in FIG. 25, the pressure roller 43 is moved to the right side in FIG. 25 to reduce the winding angle (theta) of the heat belt 40 to the pressure roller 43, so as to reduce the length H of the contact area in the sheet conveyance direction A. In this case, a decurling action performed when the sheet P passes the curved portion 40*a* of the heat belt 40 is decreased to apply a decurling force corresponding to the amount of curl of a possible back curl. Note that, in this case, a reduction in the length H of the contact area of the pressure roller 43 and the heat belt 40 in the sheet conveyance direction A decreases the time to heat the sheet P while the sheet P is pressed against the heat belt 40 by the pressure roller 43. That is, even though the amount of heat to be applied from the heat belt 40 to the sheet P is reduced, when the image area rate is relatively small and the amount of ink application to the sheet P is also relatively small, the time to heat the sheet P for drying may be relatively short. Therefore, the winding angle (theta) of the heat belt 40 to the pressure roller 43 may be reduced. Further, the amount of heat to be applied to the sheet P from the heat belt 40 decreases, the energy-saving effect is achieved.

By contrast, when an image having a high image area rate and a high amount of ink application is formed, the pressure roller 43 is moved to the left side in FIG. 25 to increase the winding angle (theta) of the heat belt 40 to the pressure roller 43, so as to increase the length H of the contact area in the sheet conveyance direction A. Accordingly, the decurling action performed when the sheet P passes the curved portion 40*a* of the heat belt 40 is increased to effectively restrain deformation of the sheet such as back curl.

Further, when a relatively thick sheet P such as a thick paper is conveyed, if the winding angle (theta) is large, it is difficult to warp and convey the sheet P. Therefore, it is preferable to make the winding angle (theta) relatively small. By making the winding angle (theta) relatively small, even when the thick sheet P is conveyed, the sheet P is smoothly conveyed, and therefore occurrence of a conveyance failure may be prevented. As described above, by accordingly changing the winding angle (theta) depending on the thickness of the sheet and the amount of ink application to the above-described sheet, deformation of the sheet is effectively restrained and the conveyance performance and the energy-saving performance are enhanced.

Further, in addition to the above-described change of the winding angle (theta) of the heat belt 40, when the amount of ink application to the sheet P is relatively small, by reducing the amount of heat generation of the heater 44, the energy-saving performance is more enhanced when compared with a case in which the amount of ink application to the sheet P is relatively large.

Further, it is preferable that the direction of movement of the pressure roller 43 when changing the winding angle (theta) of the heat belt 40 is parallel to the direction of the heat belt 40 extending downstream from the pressure roller 43 in the sheet conveyance direction A (i.e., the direction indicated by arrow C in FIG. 25). By so doing, even when the pressure roller 43 is moved, the sheet ejection direction of the sheet P from the drying device 6 may not be changed, thereby ejecting the sheet P reliably. Further, in the drying device 6 according to the present embodiment, as the sheet P passes the curved portion 40*a* of the heat belt 40, the sheet conveyance direction of the sheet P is changed. That is, by employing a belt member having the curved portion, the sheet P is changed to the desired sheet conveyance direction easily to convey the sheet P.

Further, as illustrated in FIG. 25, as the pressure roller 43 moves, the tension roller 41 moves together with the pressure roller 43, so that the tension applied to the heat belt 40 is adjusted to the predetermined value. At this time, by setting the direction of movement of the tension roller 41 to the direction obliquely downward to the left (direction indicated by arrow D in FIG. 25) and the direction opposite the direction obliquely downward to the left, the spur wheel 45 at the extreme upstream position in the sheet conveyance direction A and the heat belt 40 are continuously in contact with each other and maintain the contact state without moving the spur wheel 45 at the extreme upstream position. Accordingly, the entrance position and entrance angle at which the sheet P enters between the extreme upstream spur wheel 45 and the heat belt 40 in the sheet conveyance direction A do not change, and the entrance of the sheet P may be made reliably.

Figure 26:
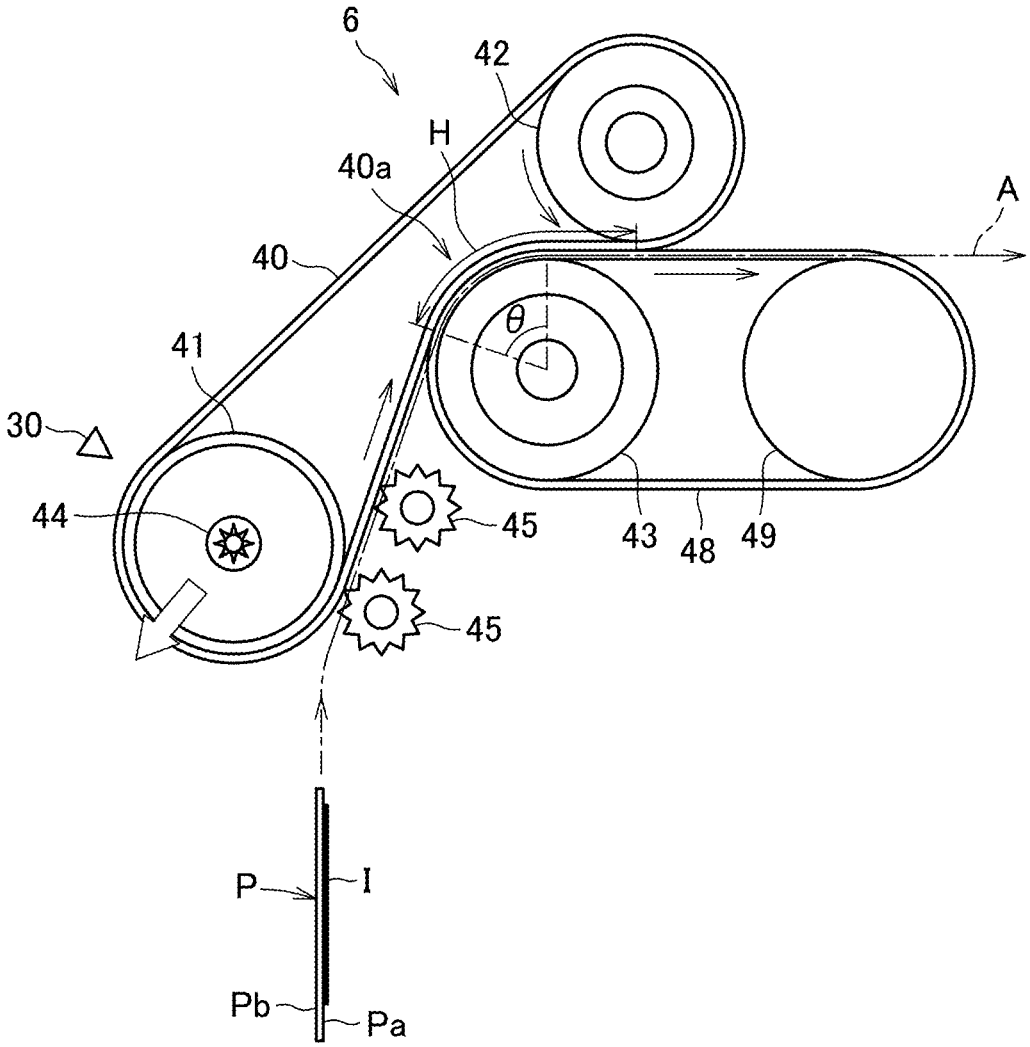
FIG. 26 is a diagram illustrating an example in which the drying device includes a pressure belt.

Further, FIG. 26 is a diagram illustrating an example in which the drying device 6 includes a pressure belt 48.

The drying device 6 illustrated in FIG. 26 includes the pressure belt 48. In this example, the pressure belt 48 having an endless loop is wound around the pressure roller 43 and a support roller 49 that is disposed downstream from the pressure roller 43 in the sheet conveyance direction A. The drying device 6 illustrated in FIG. 26 basically has the configuration identical to the configuration of the drying device 6 illustrated in FIG. 18, except the drying device 6 illustrated in FIG. 26 has the pressure belt 48 wound around the pressure roller 43 and the support roller 49.

In the drying device 6 according to FIG. 26, since the pressure roller 43 is biased toward the heat belt 40 via the pressure belt 48, the pressure belt 48 is pressed against the heat belt 40. That is, in the present embodiment, the pressure roller 43 and the pressure belt 48 each of which functions as a pressing member to press the heat belt 40. Further, in the present embodiment, as the fixed roller 42 is driven to rotate, the heat belt 40, the tension roller 41, the pressure belt 48, the pressure roller 43, and the support roller 49 are rotated along with rotation of the fixed roller 42. Further, either the pressure roller 43 or the support roller 49 may function as a drive roller.

In this case, after having passed the spur wheel 45 and then entered between the heat belt 40 and the pressure belt 48, the sheet P is conveyed as the heat belt 40 and the pressure belt 48 rotate while the sheet P is held by the heat belt 40 and the pressure belt 48. At this time, the sheet P is warped in the direction opposite the curve direction of the back curl along the curved portion 40*a* of the heat belt 40. Therefore, generation of back curl is restrained effectively. Further, the drying device 6 according to the present embodiment employs two belts (the heat belt 40 and pressure belt 48) which are in contact with each other to convey the sheet P. Therefore, the area in which the two belts convey the sheet P while gripping (holding) the sheet P (i.e., the area indicated by H in FIG. 26) extends largely in the sheet conveyance direction A. Accordingly, the sheet P is heated effectively, and the drying of ink on the sheet P is further accelerated and deformation of the sheet P such as back curl is restrained effectively.

In addition, in the drying device 6 according to FIG. 26, the pressure belt 48 is disposed to extend not to the upstream side from the curved portion 40*a* of the heat belt 40 in the sheet conveyance direction A but to the downstream side from the curved portion 40*a* of the heat belt 40 in the sheet conveyance direction A. By so doing, the sheet P contacts the heat belt 40 before the sheet P contacts the pressure belt 48, thereby accelerating the drying of ink on the sheet P. Accordingly, the application of ink to the pressure belt 48 is restrained effectively.

Further, as the example of FIG. 25, the drying device 6 illustrated in FIG. 26 may allow the pressure roller 43 to move according to the amount of ink application to the sheet P. According to this configuration, the winding angle (theta) of the heat belt 40 to the pressure belt 48 is changed to change the length H of the contact area in the sheet conveyance direction A in which the pressure belt 48 and the heat belt 40 contact with each other.

Figure 27:
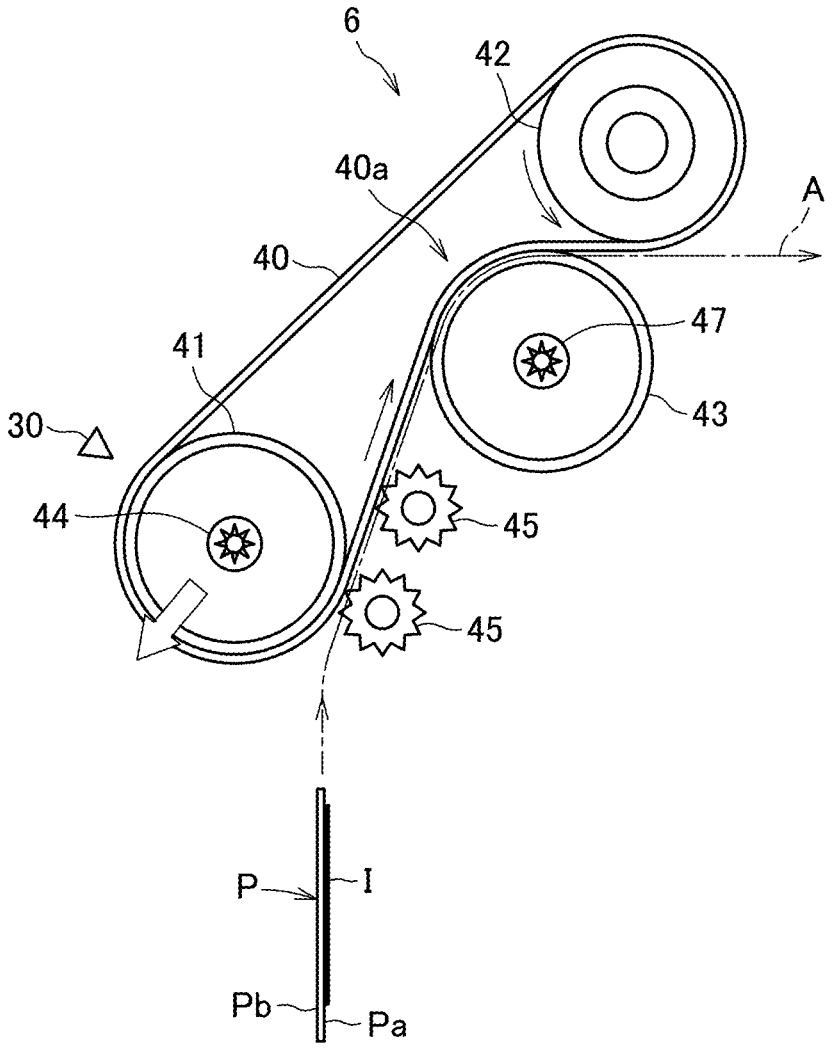
FIG. 27 is a diagram illustrating an example of the arrangement in which a heater is disposed inside the pressure roller.

FIG. 27 is a diagram illustrating an example of the arrangement in which a heater is disposed inside the pressure roller 43.

The drying device 6 illustrated in FIG. 27 is another example of the drying device 6 illustrated in FIG. 18 further including a heater 47 that functions as a heat source provided inside the pressure roller 43. The drying device 6 illustrated in FIG. 26 basically has the configuration identical to the configuration of the drying device 6 illustrated in FIG. 18, except the drying device 6 illustrated in FIG. 26 has the pressure belt 48 wound around the pressure roller 43 and the support roller 49.

In this case, the pressure roller 43 functions as a pressing member that presses the sheet P and as a heating member (heat rotator) that heats the sheet P. Therefore, when the sheet P passes the pressure roller 43, the sheet P is heated from the face that contacts the heat belt 40 (i.e., the opposite face Pb opposite the liquid applied face Pa) and the face that contacts the pressure roller 43 (i.e., the liquid applied face Pa) at the same time. Accordingly, the sheet P is heated effectively, and the drying of ink on the sheet P is further accelerated.

Further, in this case, the heat is applied to the face that contacts the heat belt 40 (i.e., the opposite face Pb opposite the liquid applied face Pa) longer than the face that contacts the pressure roller 43 (i.e., the liquid applied face Pa). Therefore, as the above-described embodiment, the opposite face Pb opposite the liquid applied face Pa of the sheet P is heated at the temperature higher than the temperature to the liquid applied face Pa. Accordingly, in this example, the force is exerted in the opposite direction opposite the force to generate a back curl on the sheet P, thereby restraining generation of the back curl. Further, in the configuration in which such a sheet P is heated from both sides (i.e., both the front and back faces), heat generation by the heater 44 and the heater 47 may be controlled in order to restrain generation of back curl more reliably.

Figure 28:
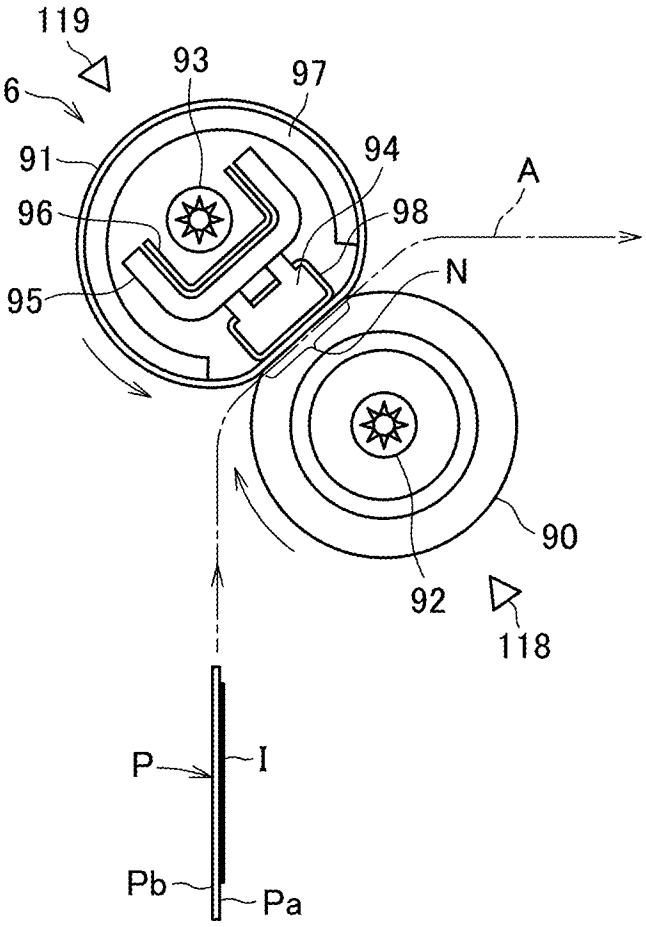
FIG. 28 is a diagram illustrating an example of controlling heat generation in each heater so that the opposite face that is opposite a liquid applied face of the sheet is heated at the higher temperature.

FIG. 28 is a diagram illustrating an example of controlling heat generation in each heater so that the opposite face Pb that is opposite the liquid applied face Pa of the sheet P is heated at the higher temperature.

The drying device 6 illustrated in FIG. 28 is an example that, by controlling heat generation in heaters 92 and 93, the opposite face Pb of the sheet P is heated at the temperature higher than the liquid applied face Pa of the sheet P.

To be more specific, the drying device 6 illustrated in FIG. 28 includes a heat roller 90, a heat belt 91, the heaters 92 and 93, a nip formation pad 94, a stay 95, a reflector 96, a belt support 97, and two temperature sensors 118 and 119.

The heat roller 90 functions a first heating member that heats the sheet P and is a cylindrical heat rotator. On the other hand, the heat belt 91 functions as a second heating member that heats the sheet P and is a cylindrical heat rotator that is a belt member radially thinner than the heat roller 90. The heat roller 90 is a roller similar to the pressure roller 10 illustrated in FIG. 17, and the heat belt 91 is a belt similar to the heat belt 40 illustrated in FIG. 17, except that the outer diameter of the heat belt 91 is smaller (for example, 30 mm) than the heat belt 40.

The heat roller 90 is biased by a pressing member such as a spring or a cam and is pressed against the nip formation pad 94 via the heat belt 91. Accordingly, the heat roller 90 is pressed against the heat belt 91, so that the nip region N is formed between the heat roller 90 and the heat belt 91. The nip formation pad 94 is preferably made of a heat-resistant resin material such as liquid crystal polymer (LCP) in order to prevent deformation due to application of heat and to form the nip region N having the stability.

Of the two heaters 92 and 93, the heater 92 is disposed inside the heat roller 90 and the heater 93 is disposed inside the heat belt 91. In the present embodiment, the heaters 92 and 93 each employs a halogen heater. A heat source included in the drying device 6 may be a radiant-heat-type heater that emits infrared rays such as a halogen heater or a carbon heater, or an electromagnetic-induction-type heat source.

In the present embodiment, in order to improve the slidability of the heat belt 91 with respect to the nip formation pad 94, a sheet-like sliding member (sliding sheet) 98 made of a low friction material such as PTFE is provided between the nip formation pad 94 and the heat belt 91. Further, in a case in which the nip formation pad 94 is made of a low friction material having slidability, the nip formation pad 94 may come into direct contact with the heat belt 91 without interposing the sliding member 98.

The stay 95 is a support that supports the nip formation pad 94 against the pressing force of the heat roller 90. Since the stay 95 supports the nip formation pad 94, the bending of the nip formation pad 94 is restrained, thereby forming the nip region N having the uniform width. Further, the stay 95 is preferably made of metal material such as SUS or SECC in order to have the good rigidity.

The reflector 96 reflects heat and light radiated from the heater. The reflector 96 is interposed between the heater 93 in the heat belt 91 and the stay 95 in the loop of the heat belt 91, so as to reflect the heat and light radiated from the heater 93 in the heat belt 91. Since the heat belt 91 receives light reflected by the reflector 96 in addition to light directly radiated from the heater 93. Therefore, the heat belt 91 is heated effectively. The reflector 96 is made of, e.g., aluminum or stainless steel.

The belt support 97 is a C-shaped or cylindrical member that supports the heat belt 91 from the inside. The belt support 97 is provided inside the heat belt 91, at both ends of the heat belt 91 in the rotational axis direction. With this configuration, the belt support 97 rotatably supports the heat belt 91. In particular, in the stationary state in which the heat belt 91 is not rotating, the heat belt 91 is basically supported in a state in which the tension is not generated in the circumferential direction of the heat belt 91.

Further, the temperature sensor 118 functions as a temperature detector to detect the surface temperature of the heat roller 90, in other words, the temperature of the outer circumferential surface of the heat roller 90. Similarly, the temperature sensor 119 functions as a temperature detector to detect the surface temperature of the heat belt 91, in other words, the temperature of the outer circumferential surface of the heat belt 91. The amount of heat generation of the heater 92 and the amount of heat generation of the heater 93 are controlled based on the temperatures detected by the temperature sensors 118 and 119, respectively, to make the surface temperature of the heat belt 91 to be higher than the surface temperature of the heat roller 90. Note that the positions of the temperature sensors 118 and 119 are not limited to the positions in FIG. 28 but may be respective positions near the nip start position of the heat roller 90 and the heat belt 91 (e.g., the entrance side of the sheet P to the nip region N). Further, respective temperature detectors may be detected to directly detect the temperatures of the heaters 92 and 93, so as to control the surface temperature of the heat belt 91 to be higher than the surface temperature of the heat roller 90 based on the temperatures detected by the temperature detectors.

In the drying device 6 illustrated in FIG. 28, as the heat roller 90 is driven to rotate in the direction indicated by arrow in FIG. 28 (i.e., the clockwise direction), the heat belt 91 is rotated along with rotation of the heat roller 90. Further, as the heaters 92 and 93 start to generate heat, the heat roller 90 and the heat belt 91 are heated. At this time, the amounts of heat generation of the heaters 92 and 93 are controlled based on the temperatures detected by the temperature sensors 118 and 119, respectively, to make the surface temperature of the heat belt 91 to be higher than the surface temperature of the heat roller 90.

In the state under the thus controlled temperature, as the sheet P enters the drying device 6 and is conveyed while being held by the heat belt 91 and the heat roller 90, the opposite face Pb of the sheet P that is opposite the liquid applied face Pa of the sheet P is heated by the heat belt 91 having the higher surface temperature. As a result, the opposite face Pb of the sheet P is heated at the temperature higher than the temperature of the liquid applied face Pa of the sheet P. Therefore, a force is exerted in the opposite direction to a force applied to the sheet P to generate the back curl. As described above, in the drying device 6 illustrated in FIG. 28, the amounts of heat generation of the heaters 92 and 93 are controlled. By so doing, the state in which the opposite face Pb of the sheet P is heated at the temperature higher than the liquid applied face Pa of the sheet P is achieved reliably, thereby restraining generation of back curl on the sheet P more effectively.

Figure 29:
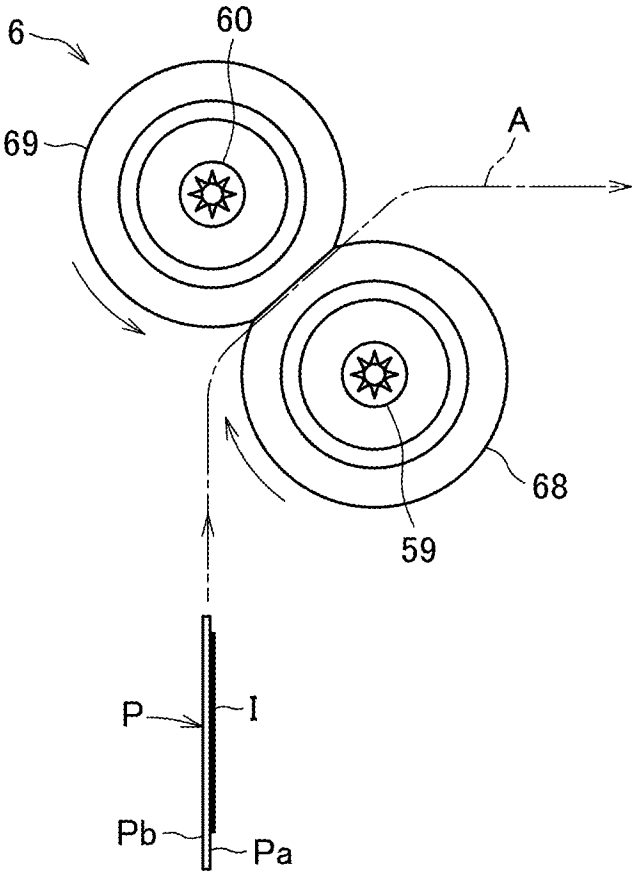
FIG. 29 is a diagram illustrating an example in which a first heating member and a second heating member are heat rollers.

Further, FIG. 29 is a diagram illustrating an example in which a pair of heat rollers function as a first heating member and a second heating member.

As illustrated in FIG. 29, the first heating member and the second heating member each heating the sheet P may be heat rollers 68 and 69. The heat rollers 68 and 69 contact (press) each other as a pair of heat rollers and have heaters 59 and 60 inside, respectively.

Figure 30:
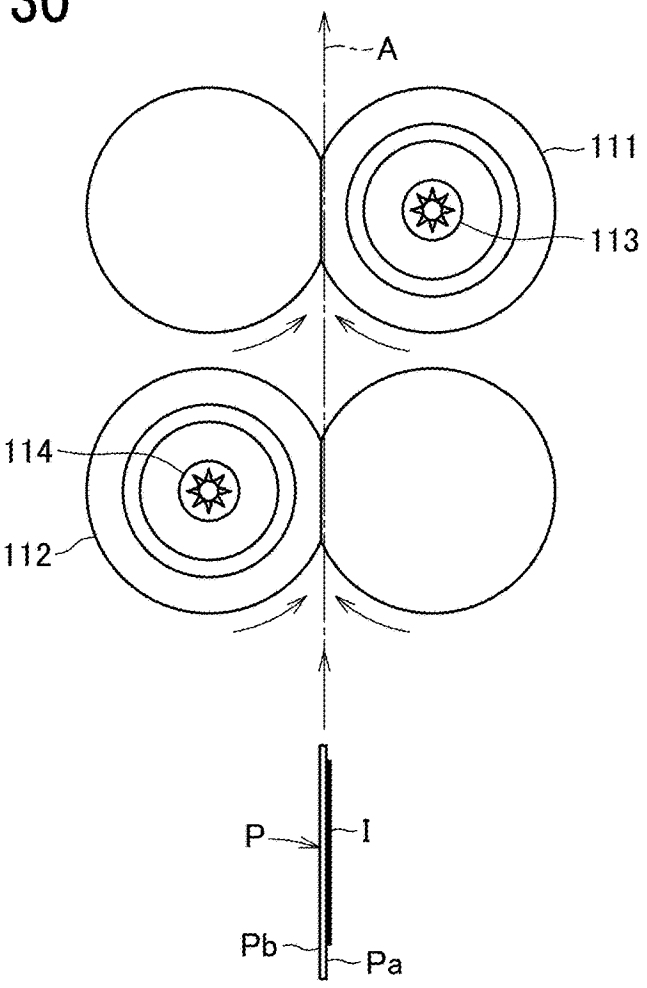
FIG. 30 is a diagram illustrating an example in which the first heating member and the second heating member do not contact with each other.

FIG. 30 is a diagram illustrating an example in which the first heating member and the second heating member do not contact with each other.

As the example illustrated in FIG. 30, the first heating member and the second heating member may not be disposed to contact with each other. In this example, a first heat roller 111 that functions as a first heating member having a heater 113 inside and a second heat roller 112 that functions as a second heating member having a heater 114 inside may be disposed at respective positions apart from each other in the sheet conveyance direction A so as not to contact with each other. In this case, in order that the opposite face Pb of the sheet P that is opposite the liquid applied face Pa of the sheet P is heated at the temperature higher than the liquid applied face Pa of the sheet P, the surface temperature of the second heat roller 112 is controlled to be higher than the surface temperature of the first heat roller 111.

However, in this case, in controlling the surface temperature of the second heat roller 112 to be higher than the surface temperature of the first heat roller 111, it is preferable to control the surface temperature in consideration of the following circumstances. That is, in the example illustrated in FIG. 30, after the sheet P has passed through the nip region of the second heat roller 112, the surface temperature of the sheet P decreases before the sheet P enters the nip region of the first heat roller 111. Therefore, the first heat roller 111 may need to heat the sheet P after the entrance of the sheet P to the nip region of the first heat roller 111, so that the temperature of the liquid applied face Pa of the sheet P does not become higher than the temperature of the opposite face Pb that is opposite the liquid applied face Pa of the sheet P. Therefore, it is preferable to control the temperature of the first heat roller 111 to be lower than the temperature of the opposite face Pb that is opposite the liquid applied face Pa of the sheet P when the sheet P enters the nip region of the first heat roller 111. By thus controlling the temperature of the first heat roller 111, the temperature of the opposite face Pb of the sheet P that is opposite the of the sheet P is maintained to be higher than the temperature of the liquid applied face Pa of the sheet P, so that back curl is restrained effectively.

Figure 31:
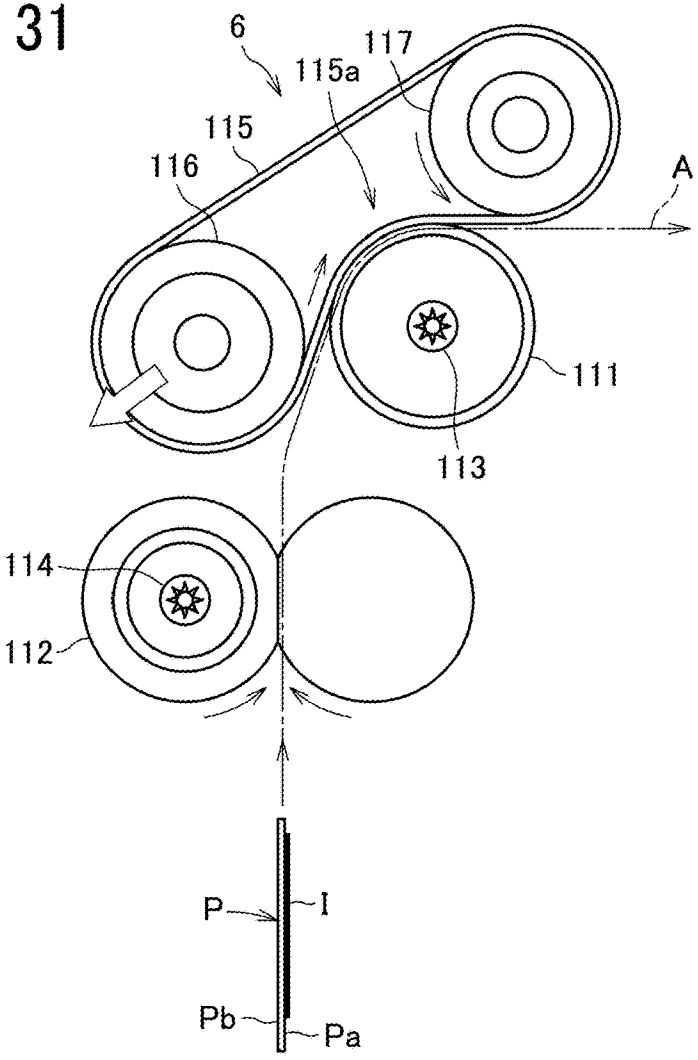
FIG. 31 is a diagram illustrating an example that a rotary body that contacts the first heat roller is a belt.

FIG. 31 is a diagram illustrating an example that a roller that contacts the first heat roller 111 is a belt.

To be more specific, the roller that contacts the first heat roller 111 in the example illustrated in FIG. 30 may be replaced to a belt 115 having an endless loop as illustrated in FIG. 31. The belt 115 illustrated in FIG. 31 is wound with tension by two support rollers 116 and 117. Since the first heat roller 111 is pressed against the belt 115, the belt 115 has a curved portion 115*a* that curves along the outer circumferential surface of the first heat roller 111.

In this case, the opposite face Pb of the sheet P is heated at the temperature higher than the liquid applied face Pa of the sheet P and the decurling action is performed on the sheet P when the sheet P passes along the curved portion 115*a* of the belt 115. Therefore, generation of the back curl is restrained effectively.

Figure 32:
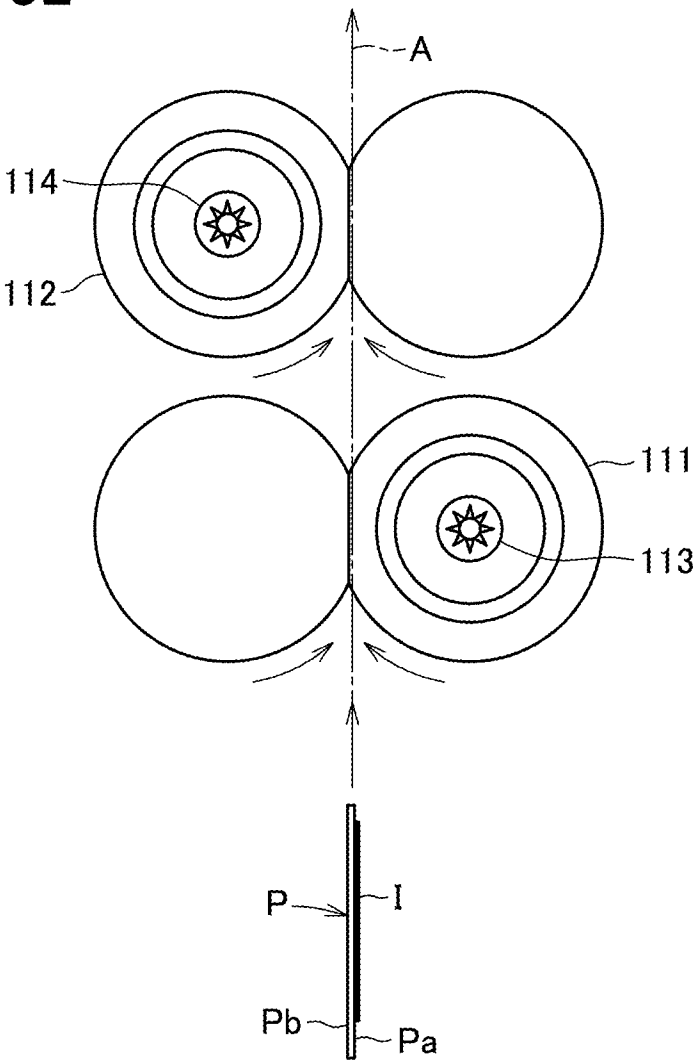
FIG. 32 is a diagram illustrating an example in which the order of the position of the first heat roller and the position of a second heat roller in a sheet conveyance direction are reversed from the order of the positions illustrated in FIG. 30.

FIG. 32 is a diagram illustrating an example in which the order of the position of the first heat roller 111 and the position of the second heat roller 112 in the sheet conveyance direction A are reversed from the order of the positions illustrated in FIG. 30.

As illustrated in FIG. 32, the order of the position of the first heat roller 111 and the position of the second heat roller 112 illustrated in FIG. 30 may be reversed from the order of the positions illustrated in FIG. 30, over the sheet conveyance direction A. That is, the first heat roller 111 may be disposed upstream from the second heat roller 112 in the sheet conveyance direction A. In this case, the sheet P first contacts the first heat roller 111, so that the liquid applied face Pa of the sheet P is heated. Then, as the sheet P contacts the second heat roller 112, the opposite face Pb that is opposite the liquid applied face Pa of the sheet P is heated. At this time, since the temperature of the second heat roller 112 is set to be higher than the temperature of the first heat roller 111, after the liquid applied face Pa of the sheet P is heated by the first heat roller 111, the opposite face Pb of the sheet P is heated by the second heat roller 112 at the higher temperature. Accordingly, the force is exerted in the opposite direction opposite the direction of the force to generate a back curl on the sheet P, thereby restraining generation of a back curl.

Figure 33:
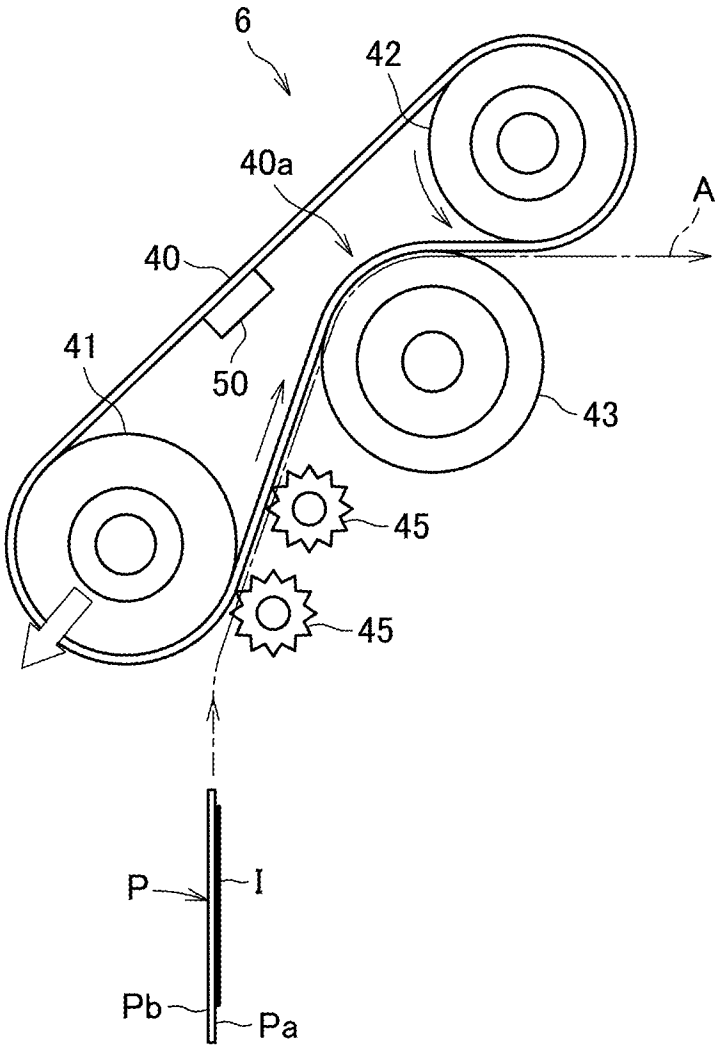
FIG. 33 is a diagram illustrating an example that a ceramic heater is employed to contact the heat belt.

Further, FIG. 33 is a diagram illustrating an example that a ceramic heater is employed to contact the heat belt.

The heater to heat the heat belt 40 illustrated in FIGS. 18 and 21 through 27 is not limited to the heater provided inside a roller but may be a ceramic heater 50 that contacts the inner circumferential surface of the heat belt 40 as illustrated in FIG. 33, for example. Further, the ceramic heater 50 may be disposed in contact with the outer circumferential surface of the heat belt 40. However, since the ceramic heater 50 relatively slides on the heat belt 40 while the heat belt 40 is rotating, in order to reduce the sliding resistance at this time, it is preferable that a slide sheet including a low friction material or a sheet metal such as aluminum having a slide coating to enhance the thermal conductivity efficiency may be inserted between the ceramic heater 50 and the heat belt 40.

Figure 34:
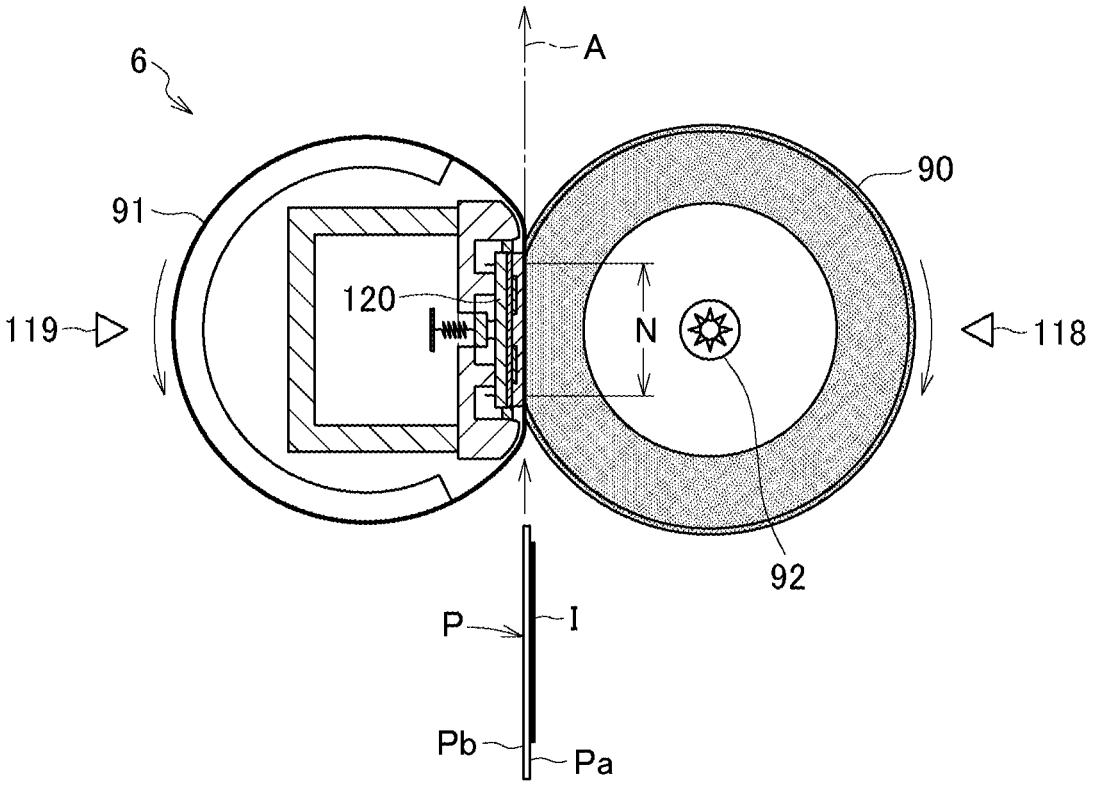
FIG. 34 is a diagram illustrating an example that a ceramic heater is employed to contact the heat belt at the nip region.

Further, FIG. 34 is a diagram illustrating an example that a ceramic heater is employed to contact the heat belt at the nip region.

As illustrated in FIG. 34, the heat source may be a ceramic heater 120 that contacts the heat belt 91 at the nip region N.

Figure 35:
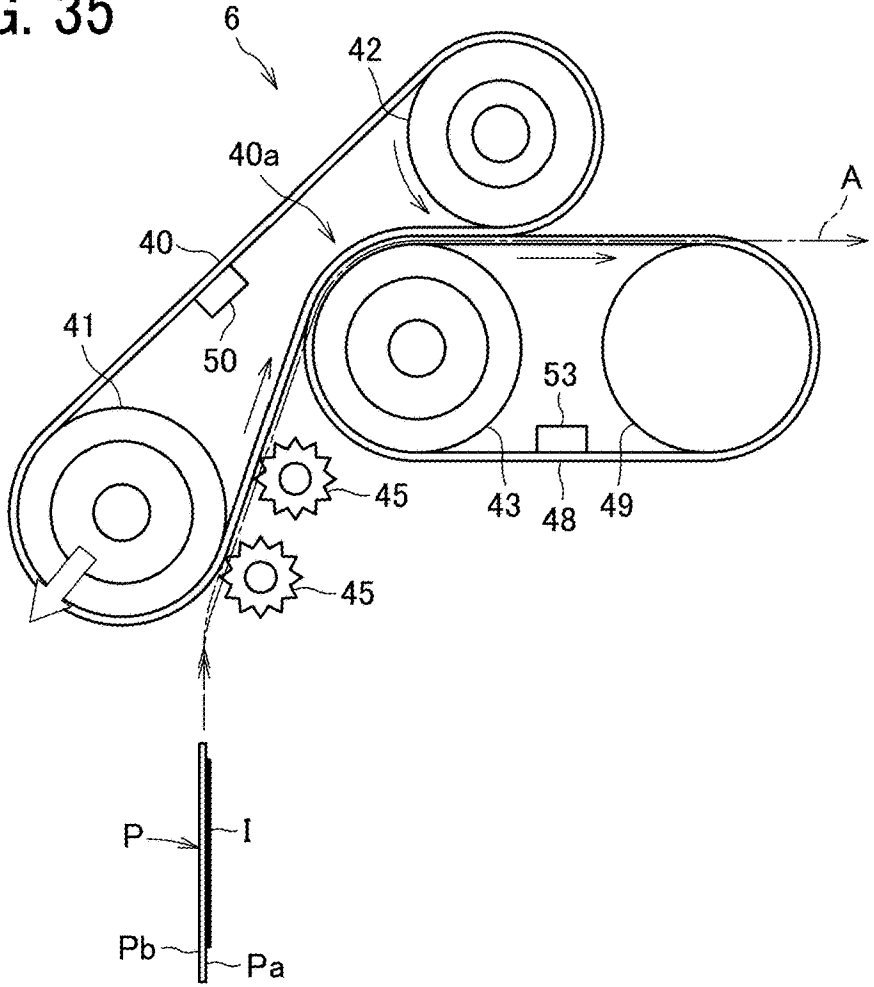
FIG. 35 is a diagram illustrating an example that a ceramic heater is employed to contact the pressure belt.

Furthermore, FIG. 35 is a diagram illustrating an example that a ceramic heater is employed to contact the pressure belt.

As illustrated in FIG. 35, a ceramic heater 53 that contacts the pressure belt 48 may be employed in addition to the ceramic heater 50 that contacts the heat belt 40.

Figure 36:
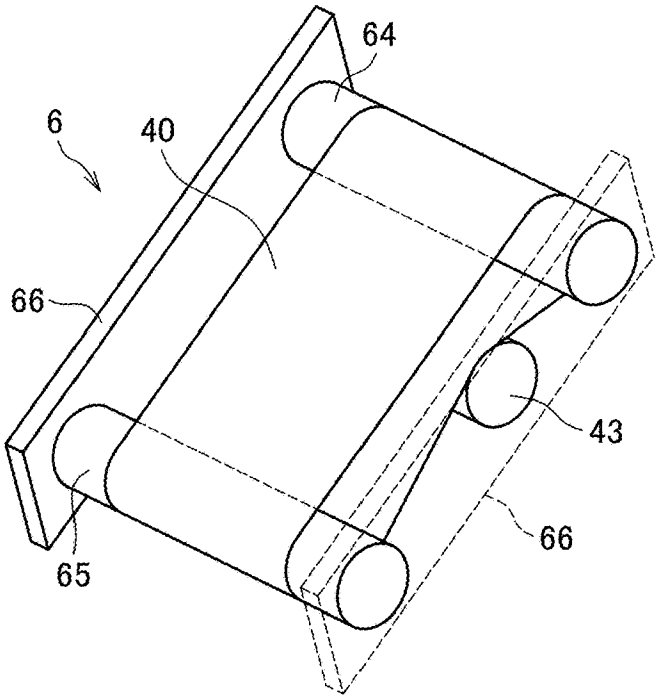
FIG. 36 is a diagram illustrating an example that the heat belt is supported by a belt support that does not rotate.

Further, FIG. 36 is a diagram illustrating an example that the heat belt is supported by a belt support that does not rotate.

The belt support that supports the heat belt 40 is not limited to a rotary body such as a roller and a belt. For example, as illustrated in FIG. 36, the heat belt 40 may be supported by a plurality of belt supports, which are a belt support 64 and a belt support 65. The belt supports 64 and 65 do not rotate. Further, each of the belt supports 64 and 65 may be constructed as separate parts or may be constructed as a single unit via a pair of frame members 66. In this case, as the pressure roller 43 is driven to rotate, the heat belt 40 is rotated along with rotation of the pressure roller 43 while sliding on the belt supports 64 and 65. At this time, it is preferable that each of the belt supports 64 and 65 includes a low friction material in order to reduce this sliding resistance between the heat belt 40 and each of the belt supports 64 and 65. Alternatively, a slide sheet that includes a low friction material may be provided between the heat belt 40 and each of the belt supports 64 and 65.

Figure 37:
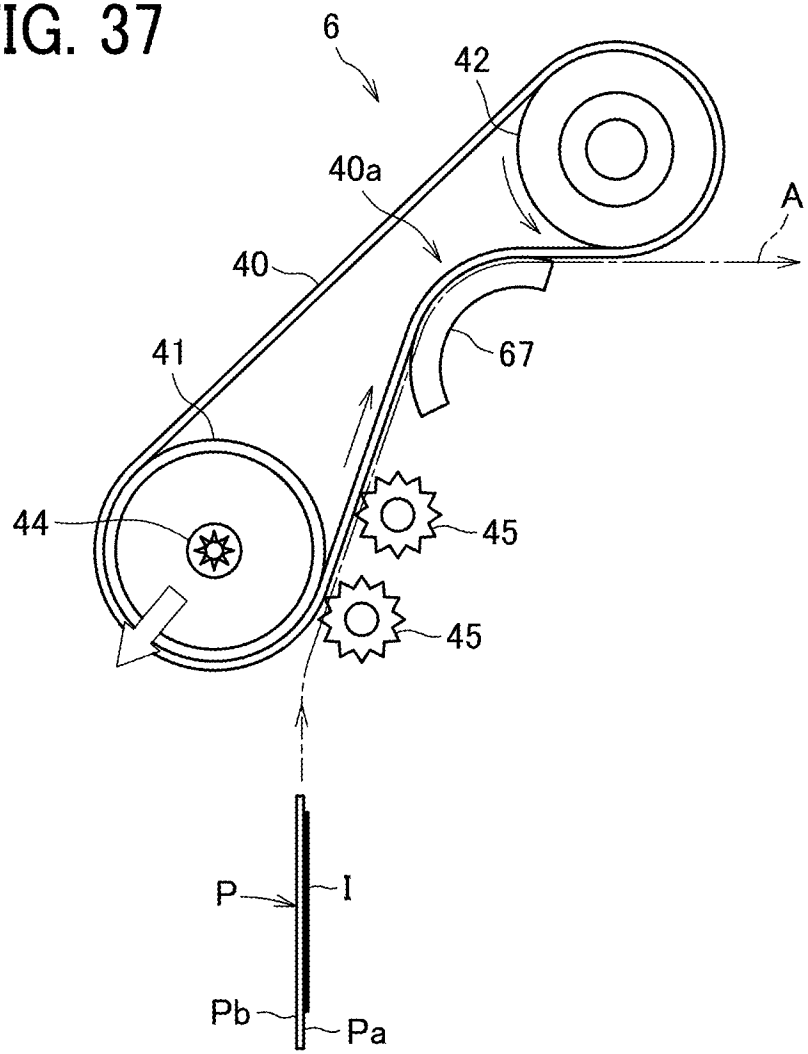
FIG. 37 is a diagram illustrating an example that the drying device employs a pressing pad that does not rotate.

Further, FIG. 37 is a diagram illustrating an example that the drying device 6 employs a pressing pad that does not rotate.

In the drying device (heating device) according to the present disclosure, the pressing member that presses the heat belt 40 to form the curved portion is not limited to a rotary body such as a pressure roller. For example, as the example illustrated in FIG. 37, the pressing member may be a pressing pad 67 that does not rotate and includes a ceramic heater having a curved surface. For example, in a case in which the liquid to be applied to the sheet is a processing liquid that does not form an image, even if the pressing pad 67 slides on the liquid applied face Pa of the sheet P, no problem of smear of the image does not occur. Therefore, the pressing pad 67 may be employed. Note that, also in this case, in order to reduce the sliding resistance that is generated between the heat belt 40 and the pressing pad 67, it is preferable to insert a slide sheet that includes a low friction material, between the heat belt 40 and the pressing pad 67.

Figure 38:
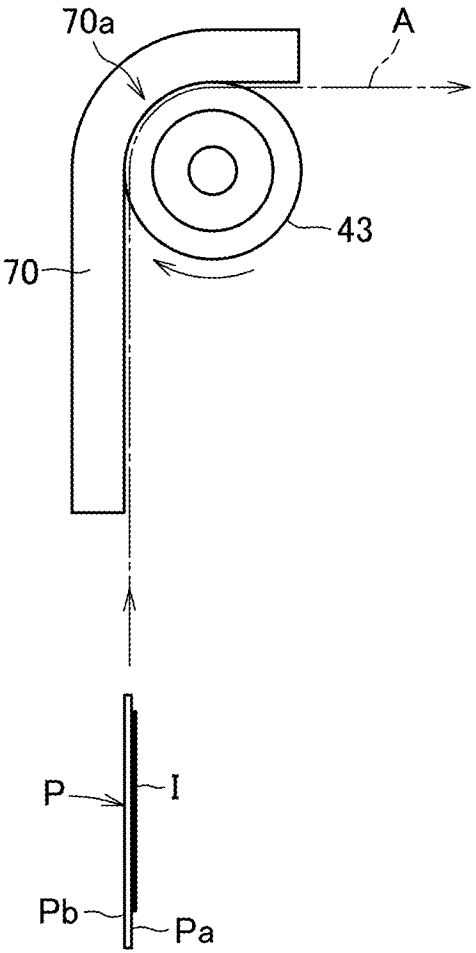
FIG. 38 is a diagram illustrating an example in which the drying device includes a heat guide.

Further, FIG. 38 is a diagram illustrating an example in which the drying device 6 includes a heat guide.

As illustrated in FIG. 38, instead of a rotary body such as the heat belt 40, a heat guide 70 that does not rotate may be employed. The heat guide 70 illustrated in FIG. 38 includes a curved portion 70*a* that warps the sheet P. As the pressure roller 43 rotates, the sheet P is conveyed while contacting the heat guide 70. At this time, the sheet P is heated by the heat guide 70 from the opposite face Pb that is opposite the liquid applied face Pa of the sheet P and is conveyed while being warped so that the liquid applied face Pa forms a concave shape when the sheet P passes the curved portion 70*a* of the heat guide 70, thereby restraining generation of back curl.

As described above, various types of configurations of the drying devices each applicable to the present disclosure. However, the drying device (heating device) according to the present disclosure is not limited to the image forming apparatus having the configuration as illustrated in FIG. 1 but may be applied to the image forming apparatus having the configuration as illustrated in FIG. 39 or the image forming apparatus having the configuration as illustrated in FIG. 40.

Figure 39:
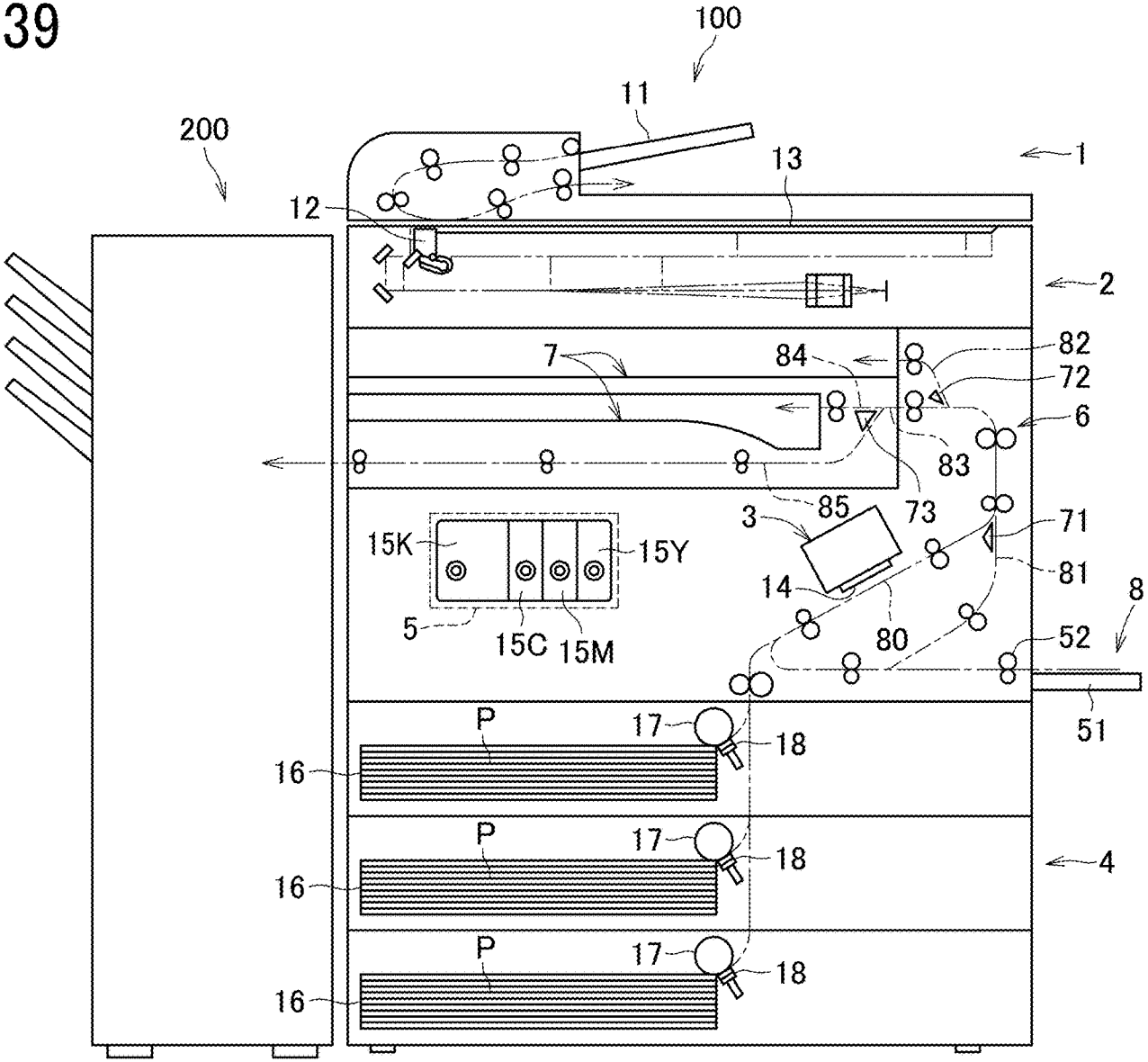
FIG. 39 is a diagram illustrating the configuration of another image forming apparatus.
Figure 40:
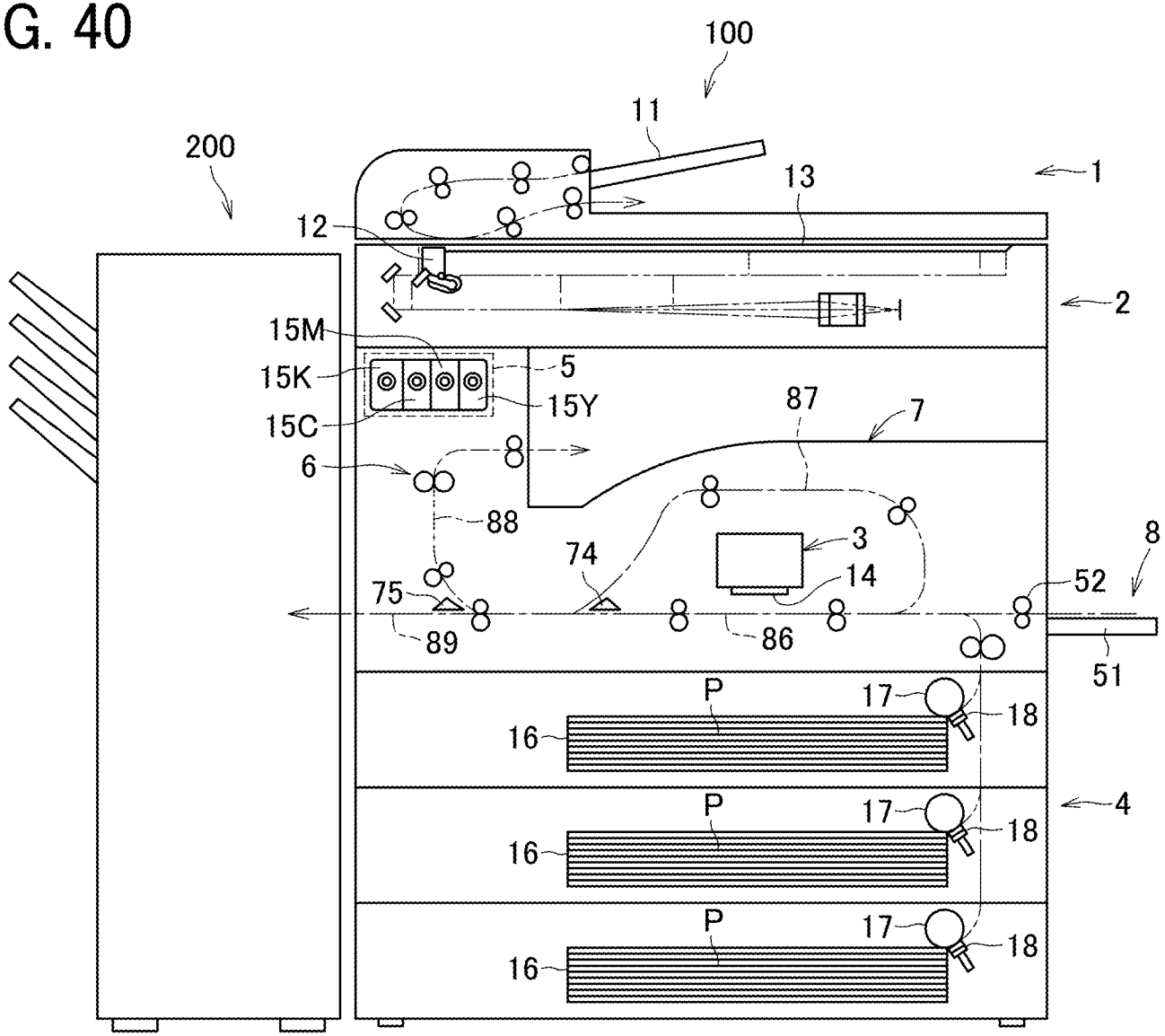
FIG. 40 is a diagram illustrating the configuration of yet another image forming apparatus.

Next, a description is given of the configuration of the image forming apparatus 100 with reference to FIGS. 39 and 40.

FIG. 39 is a diagram illustrating the configuration of another image forming apparatus 100.

FIG. 40 is a diagram illustrating the configuration of yet another image forming apparatus 100.

Note that the following description is given of the configuration of the image forming apparatus 100 of FIGS. 39 and 40 different from the configuration of the image forming apparatus 100 illustrated in FIG. 1. That is, the description of the configuration of the image forming apparatus 100 of FIGS. 39 and 40 that is same as the configuration of the image forming apparatus 100 according to the above-described embodiment, for example, the image forming apparatus 100 illustrated in FIG. 1, may be omitted.

Similar to the image forming apparatus 100 according to the above-described embodiments, the image forming apparatus 100 illustrated in FIG. 39 includes the original document conveying device 1, the image reading device 2, the image forming device 3, the sheet feeding device 4, the cartridge container 5, the drying device (heating device) 6, and the sheet ejection portion 7. Different from the image forming apparatus 100 according to the above-described embodiments, the image forming apparatus 100 illustrated in FIG. 39 further includes a bypass sheet feeding device 8. Different from the image forming device 3 in FIG. 1, the image forming device 3 in FIG. 39 is disposed facing a sheet conveyance passage 80 in which the sheet P is conveyed in a direction obliquely to the horizontal direction.

The bypass sheet feeding device 8 includes a bypass tray 51 and a bypass sheet feed roller 52. The bypass tray 51 functions as a sheet loader to load the sheet P. The bypass sheet feed roller 52 functions as a sheet feed body to feed the sheet P from the bypass tray 51. The bypass tray 51 is attached to open and close with respect to the housing of the image forming apparatus 100. In other words, the bypass tray 51 is rotatably attached to the housing of the image forming apparatus 100. When the bypass tray 51 is open (i.e., the state in FIG. 39), the sheet P or the bundle of sheets including the sheet P is loaded on the bypass tray 51 to feed the sheet P to the housing of the image forming apparatus 100.

In the image forming apparatus 100 illustrated in FIG. 39, as a print job start instruction is issued, the sheet P is supplied from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having the image on one side or both sides is conveyed to the drying device 6 in which the ink on the sheet P is dried. Note that it is preferable that, when drying the ink on the front face of the sheet P and then forming an image on the back face of the sheet P, the drying device 6 dries the ink on the front face of the sheet P first, and then, the sheet P is conveyed in a sheet conveyance passage that detours the drying device 6. Then, it is also preferable that the direction of conveyance of the sheet P is switched back (changed) to the upstream side from the drying device 6 in the sheet conveyance direction, and the sheet P is guided to the image forming device 3 again via the sheet reverse passage 81. After the sheet P has passed the drying device 6, a second passage changer 72 guides the sheet P selectively to a sheet conveyance passage 82 that runs toward the upper sheet ejection portion 7 or to a sheet conveyance passage 83 that runs to the lower sheet ejection portion 7. In a case in which the sheet P is guided to the sheet conveyance passage 82 toward the upper sheet ejection portion 7, the sheet P is ejected to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the sheet alignment apparatus 200.

Then, when the sheet P is guided to the sheet conveyance passage 84 toward the lower sheet ejection portion 7, the sheet P is ejected to the lower sheet ejection portion 7. On the other hand, when the sheet P is guided to the sheet conveyance passage 85 toward the sheet alignment apparatus 200, the sheet is conveyed to the sheet alignment apparatus 200, so that the bundle of sheets P is aligned and stacked.

Similar to the image forming apparatus 100 illustrated in FIG. 39, the image forming apparatus 100 illustrated in FIG. 40 includes the original document conveying device 1, the image reading device 2, the image forming device 3, the sheet feeding device 4, the cartridge container 5, the drying device (heating device) 6, the sheet ejection portion 7, and the bypass sheet feeding device 8. Note that, in this case, similar to the image forming device 3 included in the image forming apparatus 100 in FIG. 1, the image forming device 3 included in the image forming apparatus 100 illustrated in FIG. 40 is disposed facing a sheet conveyance passage 86 in which the sheet P is conveyed in the horizontal direction.

In the image forming apparatus 100 illustrated in FIG. 40, as a print job start instruction is issued, the sheet P is supplied from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

After an image is formed on one side or both sides of the sheet P, a second passage changer 75 guides the sheet P selectively to a sheet conveyance passage 88 that runs toward the drying device 6 or to a sheet conveyance passage 89 that runs to the sheet alignment apparatus 200. When the sheet P is guided to the sheet conveyance passage 88 toward the drying device 6, the drying device 6 dries the ink on the sheet P. Note that, when drying the ink on the front face of the sheet P and then forming an image on the back face of the sheet P, it is preferable that, after the drying device 6 has dried the ink on the front face of the sheet P first, the sheet P is conveyed in a sheet conveyance passage that detours the drying device 6. Then, it is also preferable that the direction of conveyance of the sheet P is switched back (changed) to the upstream side from the sheet conveyance passage 88 (upstream sides from the drying device 6) in the sheet conveyance direction, and the sheet P is guided to the image forming device 3 again via the sheet reverse passage 87. Consequently, the sheet P that has passed the drying device 6 is ejected to the sheet ejection portion 7. On the other hand, when the sheet P is guided to the sheet conveyance passage 89 toward the sheet alignment apparatus 200, the sheet P is conveyed to the sheet alignment apparatus 200, so that the bundle of sheets P is aligned and stacked.

Figure 41:
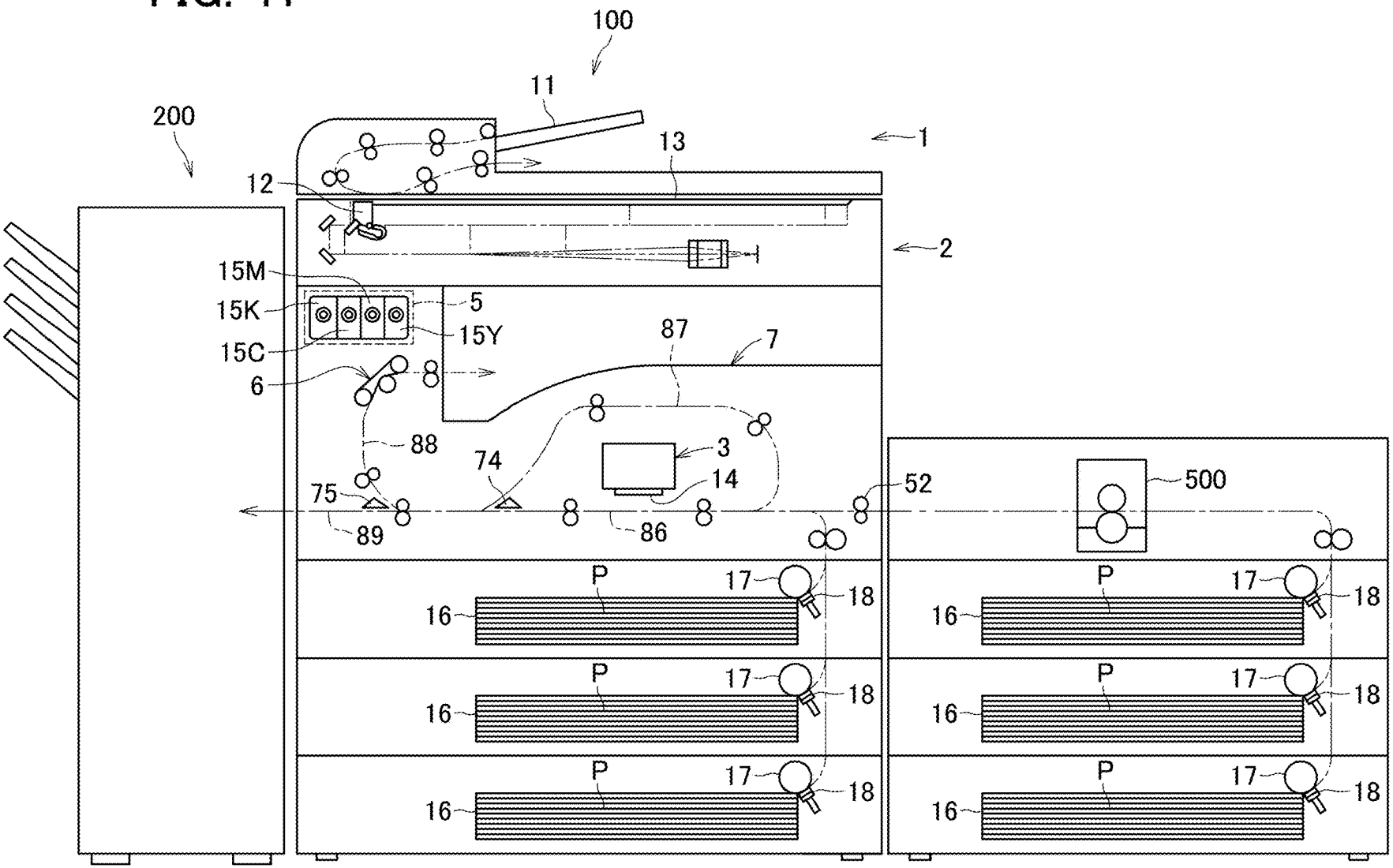
FIG. 41 is a diagram illustrating an example that the drying device according to the present disclosure is provided in a liquid applying apparatus.

For example, FIG. 41 is a diagram illustrating an example that the drying device 6 according to the present disclosure is provided in a liquid applying apparatus 1000.

That is, the drying device (heating device) according to the present disclosure may be applied to the liquid applying apparatus 1000. The liquid applying apparatus 1000 includes an inkjet image forming apparatus 100 that discharges ink to form an image on the sheet and a processing liquid applier 500 that discharges or applies a processing liquid on the surface of the sheet, as illustrated in FIG. 41, for the purpose of modifying and enhancing the surface of the sheet. Note that the processing liquid applier 500 illustrated in FIG. 41 applies a processing liquid onto the surface of the sheet P, then the liquid discharge head 14 discharges ink to apply the ink on the surface of the sheet P, and the drying device 6 dries the sheet P. However, the operation flow is not limited to the above-described flow. For example, the processing liquid applier 500 may apply a processing liquid onto the surface of the sheet P, then the drying device 6 may dry the sheet P, and the sheet may be conveyed to the sheet feed roller 17.

Further, the drying device (heating device) according to the present disclosure may be applied to a conveying device that is detachably attached to an image forming apparatus.

Figure 42:
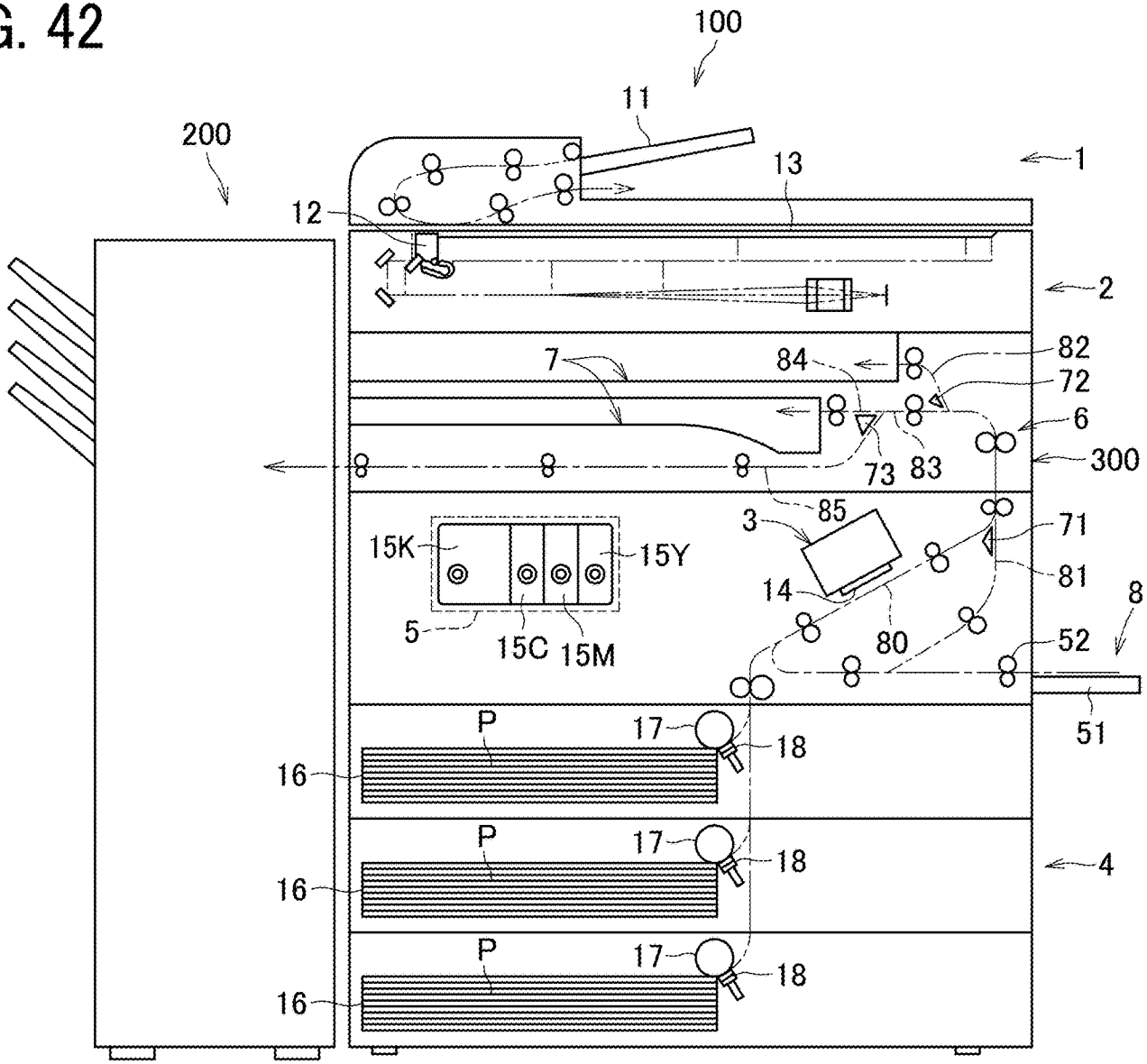
FIG. 42 is a diagram illustrating an example that the drying device according to the present disclosure is provided in a conveying device.

FIG. 42 is a diagram illustrating an example that the drying device according to the present disclosure is provided in a conveying device 300.

The conveying device 300 illustrated in FIG. 42 includes the sheet conveyance passage 85 through which the sheet that has passed the drying device 6 is conveyed to a post-processing device (for example, the sheet alignment apparatus 200) in which the post-processing operation is performed to the sheet. The conveying device 300 is detachably attached to the image forming apparatus 100, between the image reading device 2 and the image forming device 3.

Further, the drying device (heating device) according to this disclosure is also applicable to a post-processing apparatus that performs the post-processing operation such as stapling and punching to the sheet after an image has been transferred onto the sheet.

Figure 43:
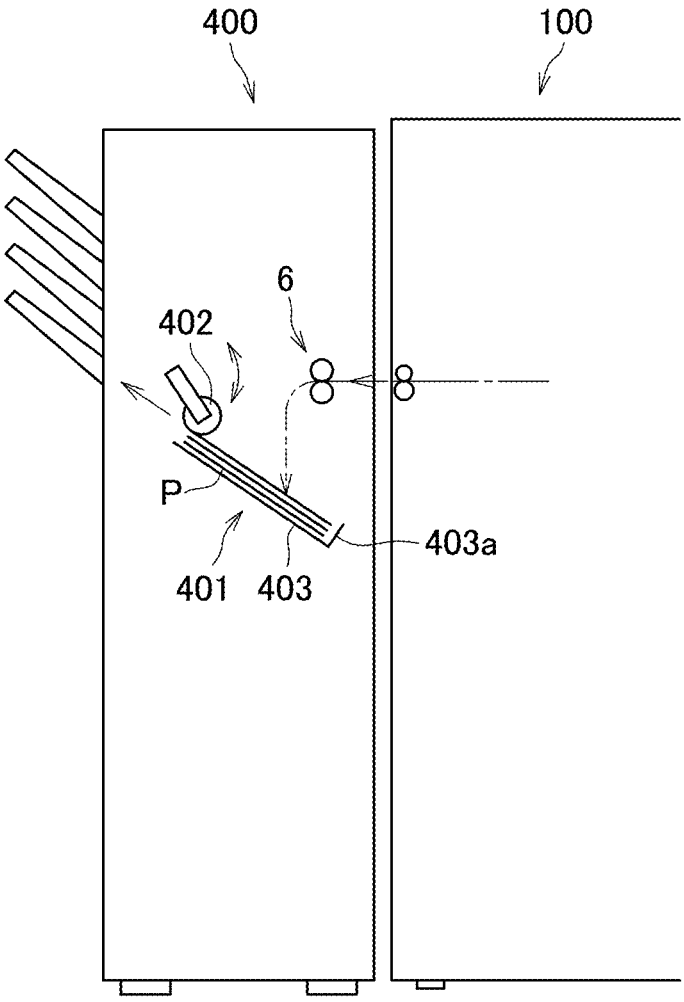
FIG. 43 is a diagram illustrating an example that the drying device according to the present disclosure is provided in a post-processing apparatus.

FIG. 43 is a diagram illustrating an example that the drying device 6 according to the present disclosure is provided in a post-processing apparatus 400.

The post-processing apparatus 400 illustrated in FIG. 43 includes the drying device 6 that heats the sheet and a post-processing device 401 that performs the post-processing operation to the sheet that has passed the drying device 6. In this case, as the sheet is conveyed from the image forming apparatus 100 to the post-processing apparatus 400, the sheet is heated by the drying device 6 and is loaded on a sheet stacking tray 403 of the post-processing device 401. At this time, in a case in which the sheet is stacked in the sheet stacking tray 403 with the face up (with the image forming surface facing up), the order of image formation may be set to be reversed, in other words, the image may be formed from the last page first. Further, the sheet P stacked on the sheet stacking tray 403 is conveyed by a sheet conveying roller 402 provided in the post-processing device 401 in the reverse direction with the trailing end of the sheet P to the leading end of the sheet P. By so doing, the trailing end of the sheet P contacts a trailing end regulator 403*a* of the sheet stacking tray 403, so that the position of the trailing end of the sheet P is aligned. Further, in order not to hinder ejection of the sheet to the sheet stacking tray 403, the sheet conveying roller 402 is disposed to be movable from a position at which the sheet conveying roller 402 contacts the sheet P to a retreat position at which the sheet conveying roller 402 does not contact the sheet P. In the state in which the position of the trailing end of the sheet P is aligned, the stapling process and the punching process are performed to the sheet P. Thereafter, the sheet conveying roller 402 rotates in the reverse direction, and therefore the sheet P on the sheet stacking tray 403 is ejected to the outside of the post-processing apparatus 400.

In the above descriptions, the drying device to which the present disclosure is applicable and the configurations of various devices and apparatuses in which the drying device is provided are explained. In various types of the drying devices described above and the apparatuses and devices including the drying device, if it is likely that the sheet sticks to a pair of sheet holding members including a roller and a belt holding the sheet, the sheet holding face of each sheet holding member may have an uneven surface, in other words, a plurality of convex portions or a plurality of concave portions. According to this structure, the sheet is restrained from sticking to the sheet holding face. Further, in order to restrain the sheet from sticking to the sheet holding face, other than providing the sheet holding face with the uneven surface having convex and concave portions, the heating temperature may be controlled to be equal to or lower than the softening point of the ink absorbing layer. In that case, the sheet holding face may or may not be uneven.

Figure 44:
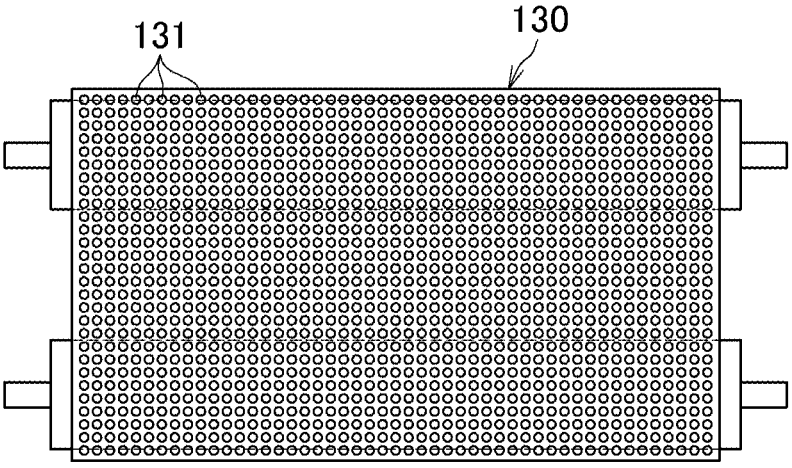
FIG. 44 is an external view illustrating an of a knurled belt.

FIG. 44 is an external view illustrating an of a knurled belt.

In the above example, the knurled roller 55 (see FIG. 3) is employed as each roller (pair of rollers) that hold the sheet. However, in a case in which a belt is employed as at least one of the sheet holding members that hold the sheet, it is preferable to employ a knurled belt 130 having a plurality of concave portions 131 (or a plurality of convex portions) formed in the outer circumferential surface, as illustrated in FIG. 44. Further, when the knurled belt 130 is employed, as the example of the knurled roller 55, the method to be employed may be embossing, blasting, or sanding paper processing. In particular, when the belt has a metal base material and is difficult to emboss, it is preferable to use blasting or sanding paper processing. Further, in a case in which the belt has multilayers including, e.g., a base material, an elastic layer, and a release layer, the surface of the base material is formed into an uneven shape first, and then the elastic layer and the release layer are formed to reflect the uneven shape, so that the processing cost is reduced.

Further, in the above example, a pair of sheet holding faces employ the uneven surface on both faces. However, only one of the pair of sheet holding faces may have the uneven surface. For example, when the ink absorbing layer (resin surface) having a low softening point is formed on the single side of the sheet only, only one sheet holding face that contacts the ink absorbing layer may be an uneven surface. Note that, even if the sheet has the ink absorbing layer on a single face (one side only), when performing the duplex printing, the ink absorbing layer contacts the sheet holding faces of both sheet holding bodies. Therefore, it is preferable that each sheet holding body has the uneven surface.

Further, the sheet to be heated by the drying device (heating device) according to the present disclosure may be a cut paper that is previously cut in the predetermined size in the sheet conveyance direction or a sheet roll that is a longitudinal-length sheet wound in a roll shape. Further, the sheet is not limited to a sheet having an ink absorbing layer on the surface and may be a sheet having a resin layer other than the ink absorbing layer. That is, as long as at least one of the front face and the back face of a sheet is a resin surface, the sheet to be applicable to the present disclosure may be a sheet having a resin surface other than the ink absorbing layer. Further, as long as at least one face of the sheet is a resin surface, the sheet may be paper sheet, resin, metal, cloth, or leather.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A heating device comprising:

a first member having a first sheet holding face; and a second member having a second sheet holding face and disposed facing the first sheet holding face of the first member, the first sheet holding face and the second sheet holding face being configured to hold a sheet between the first sheet holding face and the second sheet holding face, the sheet having a resin surface on at least one of a first face and a second face of the sheet, the heating device being configured to heat the sheet while the first sheet holding face and the second sheet holding face hold the sheet on which liquid is applied, at least one of the first sheet holding face and the second sheet holding face being configured to contact the resin surface of the sheet, the at least one of the first sheet holding face and the second sheet holding face having an uneven surface with a plurality of convex portions or a plurality of concave portions.

2. The heating device according to claim 1, wherein a temperature of the first sheet holding face and a temperature of the second sheet holding face are higher than a softening point of the resin surface of the sheet.

3. The heating device according to claim 1, wherein a temperature of the first sheet holding face and a temperature of the second sheet holding face are equal to or lower than a softening point of the resin surface of the sheet.

4. The heating device according to claim 1, wherein a temperature of the first sheet holding face and a temperature of the second sheet holding face are higher than a softening point of the resin surface in a case in which an amount of liquid applied to the sheet is greater than a predetermined amount, and wherein the temperature of the first sheet holding face and the temperature of the second sheet holding face are equal to or lower than the softening point of the resin surface in a case in which the amount of liquid applied to the sheet is equal to or smaller than the predetermined amount.

5. The heating device according to claim 4, wherein a speed at which the sheet passes between the first sheet holding face and the second sheet holding face is lower when the temperature of the first sheet holding face and the temperature of the second sheet holding face are equal to or lower than the softening point of the resin surface, than when the temperature of the first sheet holding face and the temperature of the second sheet holding face are higher than the softening point of the resin surface.

6. The heating device according to claim 1, wherein the at least one of the first sheet holding face and the second sheet holding face is made of a fluororesin.

7. The heating device according to claim 1, further comprising a separator disposed downstream from the first sheet holding face and the second sheet holding face in a sheet conveyance direction of the sheet, wherein the separator is configured to separate the sheet from the at least one of the first sheet holding face and the second sheet holding face.

8. The heating device according to claim 1, wherein the first member having the first sheet holding face is a belt configured to heat the sheet from a face opposite a liquid applied face of the sheet, and wherein the second member having the second sheet holding face is a pressing member configured to press an outer circumferential surface of the belt to form a curved portion of the belt.

9. The heating device according to claim 1, wherein the first member having the first sheet holding face includes a first heating member configured to heat a liquid applied face of the sheet, wherein the second member having the second sheet holding face includes a second heating member configured to heat a face opposite the liquid applied face of the sheet, and wherein a temperature of the second heating member is higher than a temperature of the first heating member.

10. A liquid applying apparatus comprising:

a liquid applier configured to apply liquid to a sheet; and the heating device according to claim 1.

11. An image forming apparatus comprising:

an image forming device configured to form an image on a sheet with liquid; and the heating device according to claim 1.

12. A post-processing apparatus comprising:
the heating device according to claim 1; and
a post-processing device configured to perform a post-processing operation to a sheet that has passed the heating device.

13. A conveying device comprising:
the heating device according to claim 1; and
a conveyance passage configured to convey a sheet that has passed the heating device, to a post-processing device to perform a post-processing operation to the sheet.

14. A heating device comprising:
a first member having a first sheet holding face; and
a second member having a second sheet holding face and disposed facing the first sheet holding face of the first member,
the first sheet holding face and the second sheet holding face being configured to hold a sheet between the first sheet holding face and the second sheet holding face, the sheet having a resin surface on at least one of a first face and a second face of the sheet,
the heating device being configured to heat the sheet while the first sheet holding face and the second sheet holding face hold the sheet on which liquid is applied,
a temperature of the first sheet holding face and a temperature of the second sheet holding face being equal to or lower than a softening point of the resin surface of the sheet.

15. The heating device according to claim 14,
wherein the temperature of the first sheet holding face and the temperature of the second sheet holding face are lower when an amount of liquid applied to the sheet is equal to or smaller than a predetermined amount, than when the amount of liquid applied to the sheet is greater than the predetermined amount.

16. The heating device according to claim 15,
wherein a speed at which the sheet passes between the first sheet holding face and the second sheet holding face is lower when the temperature of the first sheet holding face and the temperature of the second sheet holding face are low, than when the temperature of the first sheet holding face and the temperature of the second sheet holding face are high.

17. The heating device according to claim 14,
wherein the at least one of the first sheet holding face and the second sheet holding face is made of a fluororesin.

18. The heating device according to claim 14, further comprising a separator disposed downstream from the first sheet holding face and the second sheet holding face in a sheet conveyance direction of the sheet,
wherein the separator is configured to separate the sheet from the at least one of the first sheet holding face and the second sheet holding face.

19. The heating device according to claim 14,
wherein the first member having the first sheet holding face is a belt configured to heat the sheet from a face opposite a liquid applied face of the sheet, and
wherein the second member having the second sheet holding face is a pressing member configured to press an outer circumferential surface of the belt to form a curved portion of the belt.

20. The heating device according to claim 14,
wherein the first member having the first sheet holding face includes a first heating member configured to heat a liquid applied face of the sheet,
wherein the second member having the second sheet holding face includes a second heating member configured to heat a face opposite the liquid applied face of the sheet, and
wherein a temperature of the second heating member is higher than a temperature of the first heating member.

21. A liquid applying apparatus comprising:
a liquid applier configured to apply liquid to a sheet; and
the heating device according to claim 14.

22. An image forming apparatus comprising:
an image forming device configured to form an image on a sheet with liquid; and
the heating device according to claim 14.

23. A post-processing apparatus comprising:
the heating device according to claim 14; and
a post-processing device configured to perform a post-processing operation to a sheet that has passed the heating device.

24. A conveying device comprising:
the heating device according to claim 14; and
a conveyance passage configured to convey a sheet that has passed the heating device, to a post-processing device to perform a post-processing operation to the sheet.

* * * * *